US008220910B2

(12) United States Patent
Wanibe

(10) Patent No.: US 8,220,910 B2
(45) Date of Patent: Jul. 17, 2012

(54) LIQUID SUPPLY SYSTEM AND MANUFACTURING METHOD OF THE SAME

(75) Inventor: Akihisa Wanibe, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 410 days.

(21) Appl. No.: 12/468,675

(22) Filed: May 19, 2009

(65) Prior Publication Data

US 2009/0295885 A1 Dec. 3, 2009

(30) Foreign Application Priority Data

May 27, 2008 (JP) ..... 2008-138569

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS

| | | | | |
|---|---|---|---|---|
| 7,581,808 | B2 | 9/2009 | Ishizawa et al. | |
| 7,828,425 | B2 * | 11/2010 | Kang et al. | 347/93 |

FOREIGN PATENT DOCUMENTS

| | | | |
|---|---|---|---|
| CN | 101121337 | A | 2/2008 |
| EP | 1 388 419 | A1 | 2/2004 |
| JP | 2000-141687 | A | 5/2000 |
| JP | 2002-120374 | A | 4/2002 |
| JP | 2006-021380 | A | 1/2006 |
| JP | 2006-305942 | A | 11/2006 |
| JP | 2008-44200 | | 2/2008 |
| JP | 2008-68614 | | 3/2008 |

OTHER PUBLICATIONS

European Search Report issued in prosecution of EP 06 16 0912, which is an European application corresponding to the subject application.

* cited by examiner

*Primary Examiner* — Matthew Luu
*Assistant Examiner* — Erica Lin
(74) *Attorney, Agent, or Firm* — Stroock & Stroock & Lavan LLP

(57) ABSTRACT

An ink cartridge 1 constructed as a liquid container has wall faces 1*a*, 370*w*1, and 370*w*2 that are respectively pierced to have holes. One end of an ink supply tube 910 is inserted through the holes of the wall faces 1*a*, 370*w*1, and 370*w*2 and is connected with an inlet 401 of a vertical communicating path 400 located in the upstream of a sensor unit 30 functioning as a detector. The other end of the ink supply tube 910 is connected to a large-capacity ink tank 900. Attachment of the ink cartridge 1 to an ink-jet printer completes an ink supply system. This arrangement effectively controls or prevents migration of bubbles into the detector in the liquid container equipped with the detector.

12 Claims, 29 Drawing Sheets

FIRST CONNECTION EXAMPLE

SECOND CONNECTION EXAMPLE

THIRD CONNECTION EXAMPLE

LIQUID SUPPLY SYSTEM AND MANUFACTURING METHOD OF THE SAME

CROSS-REFERENCE TO RELATED APPLICATIONS

This application claims priority to Japanese Patent Application No. 2008-138569, filed on May 27, 2008, the entire disclosure of which is incorporated herein by reference:

BACKGROUND OF THE INVENTION

1. Field of the Invention

The present invention relates to a liquid supply system configured to supply a liquid to a liquid ejection apparatus, as well as to a manufacturing method of such a liquid supply system.

2. Description of the Related Art

One typical example of the liquid ejection apparatus is an ink-jet printer. The ink-jet printer generally receives a supply of ink from an ink cartridge of a predetermined capacity attached thereto and performs printing. One proposed technique for printing with a large mass of ink exceeding the capacity of an ink cartridge supplies ink to the ink cartridge through a tube from a large capacity ink tank outside the ink-jet printer.

One practically applied structure of the ink cartridge has a sensor for detecting the remaining quantity of ink. Simple attachment of the tube to the ink cartridge with such a sensor may cause false detection of the sensor.

This problem is not characteristic of the ink cartridge but is commonly found in diversity of liquid containers used for supplying liquid to a liquid ejection apparatus, for example, a liquid container for supplying a metal-containing liquid material to an injection device designed to inject the liquid material onto a semiconductor substrate and thereby form an electrode layer on the semiconductor substrate.

SUMMARY OF THE INVENTION

In order to solve at least part of the problems mentioned above, there would be a demand for controlling or preventing migration of bubbles into a detector in a liquid container equipped with the detector.

The present invention accomplishes at least part of the demand mentioned above and the other relevant demands by variety of configurations discussed below.

According to a first aspect, the invention is directed to a liquid supply system configured to supply a liquid to a liquid ejection apparatus. The liquid supply system includes: a liquid container having a liquid reservoir assembly designed to store the liquid therein, an air communicating structure provided in the upstream of the liquid reservoir assembly to connect the liquid reservoir assembly with the outside air, a bubble separation structure provided in the downstream of the liquid reservoir assembly to separate bubbles included in the liquid, a first communicating path arranged to connect the bubble separation structure with the liquid reservoir assembly, a detector located in the downstream of the bubble separation structure to detect a liquid level in the liquid reservoir assembly, and a liquid supply structure provided in the downstream of the detector to supply the liquid to the liquid ejection apparatus; a liquid supply line connected with the liquid container in the upstream of the detector; and an external liquid supply device connected with the liquid supply line to supply the liquid to the liquid container.

In the liquid supply system according to the first aspect of the invention, the liquid supply line is connected with the liquid container in the upstream of the detector. This configuration desirably controls or prevents migration of bubbles into the detector in the liquid container equipped with the detector.

In one preferable application of the liquid supply system according to the first aspect of the invention, the liquid supply line is connected with the first communicating path. In the liquid supply system of this arrangement, the liquid is supplied to a specific position close to the detector, while the bubble separation structure effectively controls or prevents migration of bubbles into the detector.

In one preferable embodiment of the liquid supply system according to the first aspect of the invention, the liquid reservoir assembly has a first liquid reservoir, a second liquid reservoir provided in the downstream of the first liquid reservoir, and a second communicating path arranged to connect the first liquid reservoir with the second liquid reservoir. The liquid supply line is connected with the second communicating path. In the liquid supply system of this embodiment, the liquid is directly supplied to the second liquid reservoir, while the bubble separation structure effectively controls or prevents migration of bubbles into the detector.

In another preferable embodiment of the liquid supply system according to the first aspect of the invention, the liquid reservoir assembly has a first liquid reservoir, a second liquid reservoir provided in the downstream of the first liquid reservoir, and a second communicating path arranged to connect the first liquid reservoir with the second liquid reservoir. The liquid supply system of this embodiment further has a third communicating path arranged to connect the first liquid reservoir with the air communicating structure. The liquid supply line is connected with the first liquid reservoir, and the third communicating path is blocked. In the liquid supply system of this embodiment, the liquid is directly supplied to the first liquid reservoir, while the bubble separation structure effectively controls or prevents migration of bubbles into the detector.

According to a second aspect, the invention is also directed to a manufacturing method of a liquid supply system configured to supply a liquid to a liquid ejection apparatus. The manufacturing method of the liquid supply system provides a liquid container, which is attachable to the liquid ejection apparatus and has a liquid reservoir assembly designed to store the liquid therein, an air communicating structure provided to connect the liquid reservoir assembly with the outside air, a bubble separation structure provided in the downstream of the liquid reservoir assembly to separate bubbles included in the liquid, a first communicating path arranged to connect the bubble separation structure with the liquid reservoir assembly, a detector located in the downstream of the bubble separation structure to detect a liquid level in the liquid reservoir assembly, and a liquid supply structure provided in the downstream of the detector to supply the liquid to the liquid ejection apparatus. The manufacturing method of the liquid supply system then connects a liquid supply line with the liquid container in the upstream of the detector, and connects the liquid supply line to an external liquid supply device constructed to supply the liquid to the liquid container.

In the manufacturing method of the liquid supply system according to the second aspect of the invention, the liquid supply line is connected with the liquid container in the upstream of the detector. This configuration desirably controls or prevents migration of bubbles into the detector in the liquid container equipped with the detector.

In one preferable application of the manufacturing method of the liquid supply system according to the second aspect of the invention, the liquid supply line is connected with the liquid container by linking the liquid supply line to the first communicating path. This arrangement ensures the supply of the liquid to a specific position close to the detector, while effectively controlling or preventing migration of bubbles into the detector by means of the bubble separation structure.

In one preferable embodiment of the manufacturing method of the liquid supply system according to this application, a concrete procedure of connecting the liquid supply line with the liquid container pierces or cuts out an outer wall member of the liquid container, which is exposed on an attachment structure of the liquid ejection apparatus in attachment of the liquid container to the attachment structure, and at least one wall member provided in a pathway from the outer wall member to the first communicating path to form holes or cutouts. The procedure then lays out the liquid supply line to the first communicating path via the holes or cutouts formed in the outer wall member and the at least one wall member, and connects and seals one end of the liquid supply line with the first communicating path. This arrangement allows the liquid supply line to be adequately fastened to the liquid container, while effectively controlling or preventing migration of bubbles into the detector by means of the bubble separation structure.

In another preferable application of the manufacturing method of the liquid supply system according to the second aspect of the invention, the liquid reservoir assembly has a first liquid reservoir, a second liquid reservoir provided in the downstream of the first liquid reservoir, and a second communicating path arranged to connect the first liquid reservoir with the second liquid reservoir. The liquid supply line is connected with the liquid container by linking the liquid supply line to the second communicating path. This arrangement ensures the direct supply of the liquid to the second liquid reservoir, while effectively controlling or preventing migration of bubbles into the detector by means of the bubble separation structure.

In one preferable embodiment of the manufacturing method of the liquid supply system according to this application, a concrete procedure of connecting the liquid supply line with the liquid container pierces or cuts out an outer wall member of the liquid container, which is exposed on an attachment structure of the liquid ejection apparatus in attachment of the liquid container to the attachment structure, and at least one wall member provided in a pathway from the outer wall member to the second communicating path to form holes or cutouts. The procedure then lays out the liquid supply line to the second communicating path via the holes or cutouts formed in the outer wall member and the at least one wall member, and connects and seals one end of the liquid supply line with the second communicating path. This arrangement allows the liquid supply line to be adequately fastened to the liquid container, while effectively controlling or preventing migration of bubbles into the detector by means of the bubble separation structure.

In still another preferable application of the manufacturing method of the liquid supply system according to the second aspect of the invention, the liquid reservoir assembly has a first liquid reservoir, a second liquid reservoir provided in the downstream of the first liquid reservoir, and a second communicating path arranged to connect the first liquid reservoir with the second liquid reservoir. The manufacturing method of the liquid supply system connects the first liquid reservoir with the air communicating structure via a third communicating path, links the liquid supply line to the first liquid reservoir to connect the liquid supply line with the liquid container, and blocks the third communicating path. This arrangement ensures the direct supply of the liquid to the first liquid reservoir, while effectively controlling or preventing migration of bubbles into the detector by means of the bubble separation structure.

In one preferable embodiment of the manufacturing method of the liquid supply system according to this application, a concrete procedure of connecting the liquid supply line with the liquid container pierces or cuts out an outer wall member of the liquid container, which is exposed on an attachment structure of the liquid ejection apparatus in attachment of the liquid container to the attachment structure, and at least one wall member provided in a pathway from the outer wall member to the first liquid reservoir to form holes or cutouts. The procedure then lays out the liquid supply line to the first liquid reservoir via the holes or cutouts formed in the outer wall member and the at least one wall member, and connects and seals one end of the liquid supply line with a hole or a cutout formed in a wall member of the first liquid reservoir. This arrangement allows the liquid supply line to be adequately fastened to the liquid container, while effectively controlling or preventing migration of bubbles into the detector by means of the bubble separation structure.

According to a third aspect, the invention is further directed to a manufacturing method of a liquid container used for a liquid supply system configured to supply a liquid to a liquid ejection apparatus. The manufacturing method of the liquid container first provides the liquid container, which is attachable to the liquid ejection apparatus and has a liquid reservoir assembly designed to store the liquid therein, an air communicating structure provided to connect the liquid reservoir assembly with the outside air, a bubble separation structure provided in the downstream of the liquid reservoir assembly to separate bubbles included in the liquid, a first communicating path arranged to connect the bubble separation structure with the liquid reservoir assembly, a detector located in the downstream of the bubble separation structure to detect a liquid level in the liquid reservoir assembly, and a liquid supply structure provided in the downstream of the detector to supply the liquid to the liquid ejection apparatus. The manufacturing method of the liquid container then connects a liquid supply line to the liquid container in the upstream of the detector.

In the manufacturing method of the liquid container according to the third aspect of the invention, the liquid supply line is connected with the liquid container in the upstream of the detector. This configuration desirably controls or prevents migration of bubbles into the detector in the liquid container equipped with the detector.

In one preferable embodiment of the manufacturing method of the liquid container according to the third aspect of the invention, a concrete procedure of connecting the liquid supply line with the liquid container pierces or cuts out an outer wall member of the liquid container, which is exposed on an attachment structure of the liquid ejection apparatus in attachment of the liquid container to the attachment structure, and at least one wall member provided in a pathway from the outer wall member to the first communicating path to form holes or cutouts. The procedure then lays out the liquid supply line to the first communicating path via the holes or cutouts formed in the outer wall member and the at least one wall member, and connects and seals one end of the liquid supply line with the first communicating path. This arrangement ensures the supply of the liquid to a specific position close to the detector, while effectively controlling or preventing migration of bubbles into the detector by means of the bubble separation structure.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF PREFERRED EMBODIMENTS

One mode of the liquid container according to the invention is described below as a preferred embodiment with reference to the accompanied drawings. The following embodiment describes an ink cartridge as one typical example of the liquid container.

A. Structure of Ink Cartridge

Figure 1:
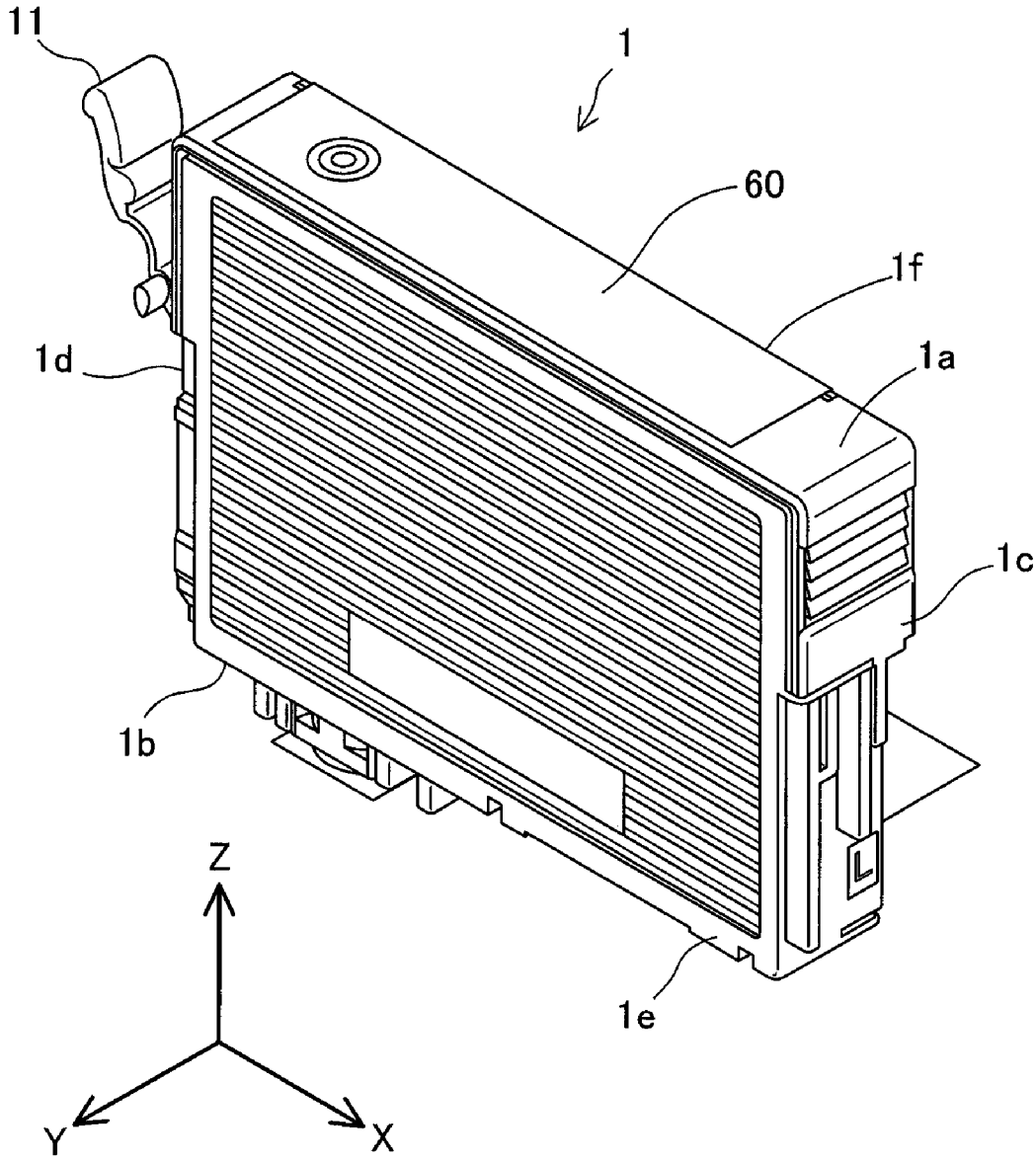
FIG. 1 is a perspective view showing the front-side appearance of an ink cartridge as a liquid container in one embodiment of the invention.
Figure 2:
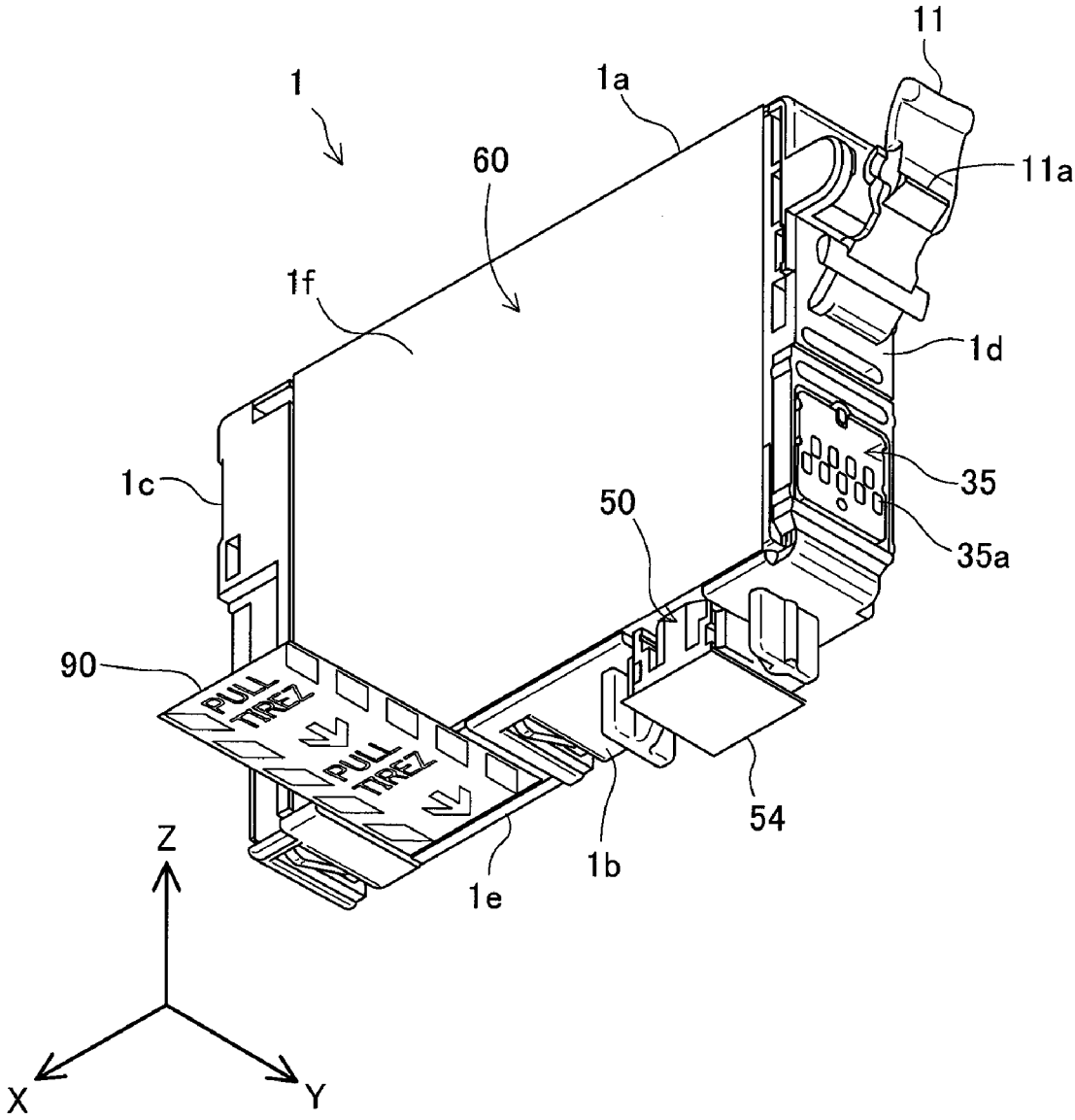
FIG. 2 is a perspective view showing the rear-side appearance of the ink cartridge of the embodiment.
Figure 3:
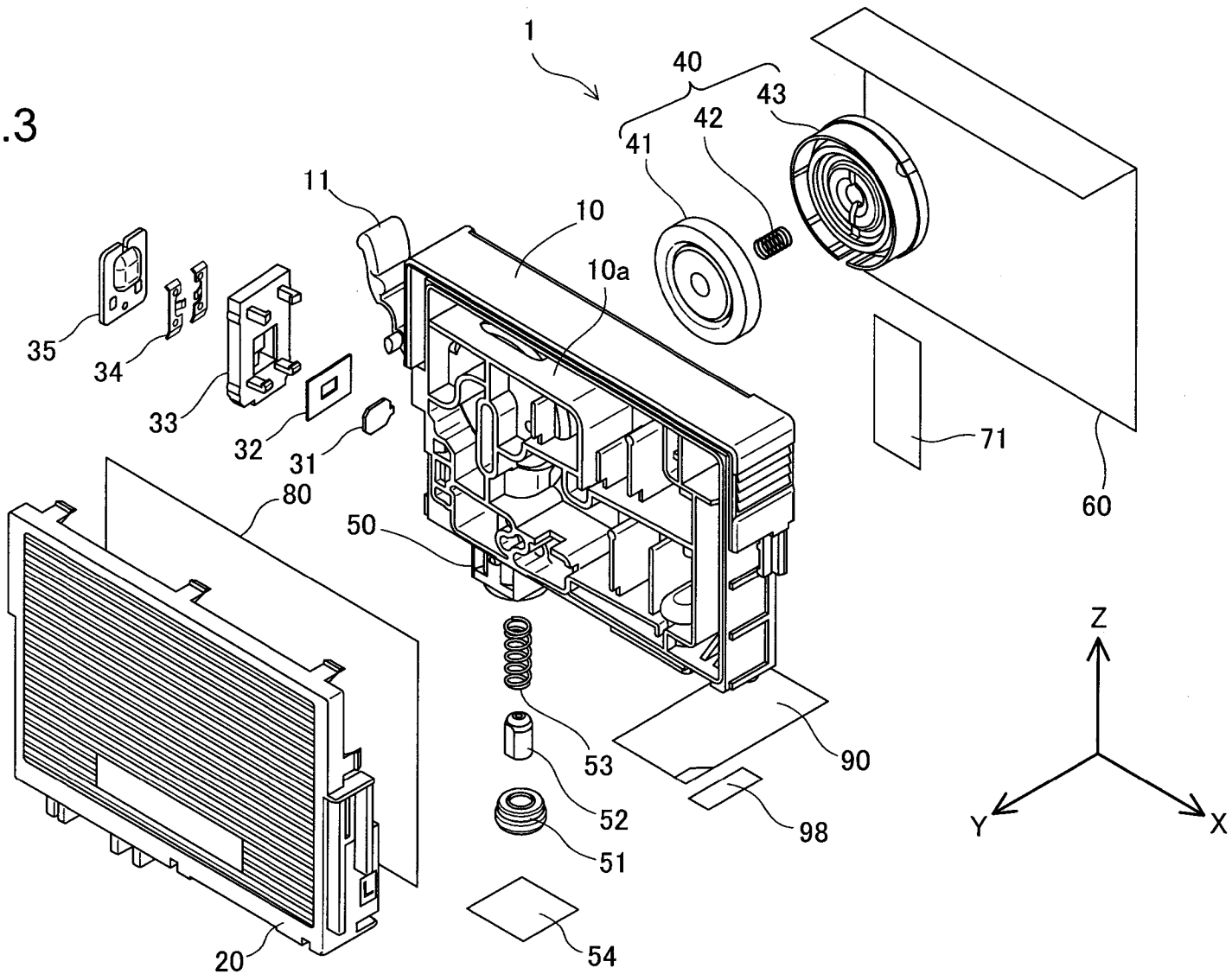
FIG. 3 is an exploded perspective view of the ink cartridge of the embodiment seen from the front side corresponding to FIG. 1.
Figure 4:
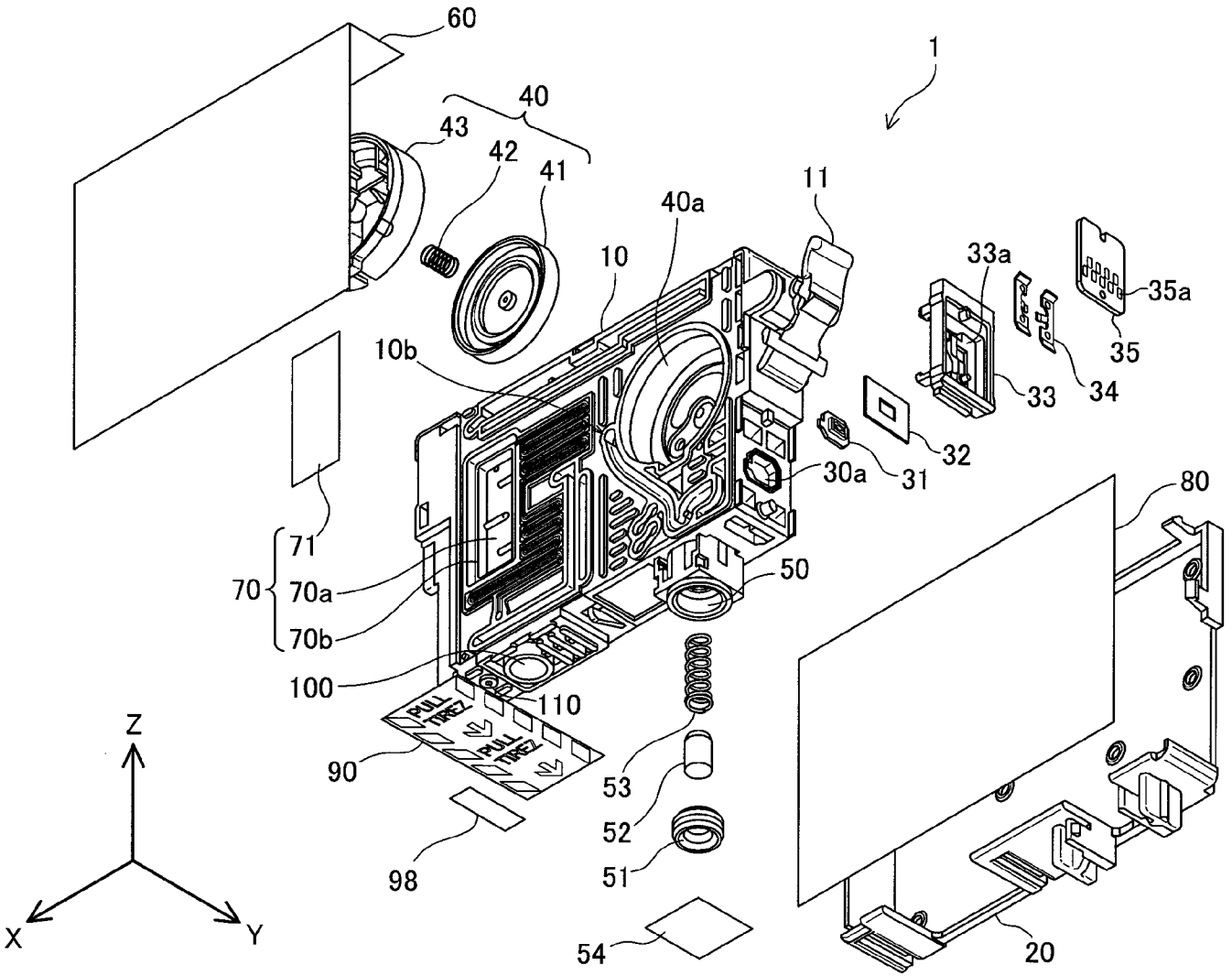
FIG. 4 is an exploded perspective view of the ink cartridge of the embodiment seen from the rear side corresponding to FIG. 2.
Figure 5:
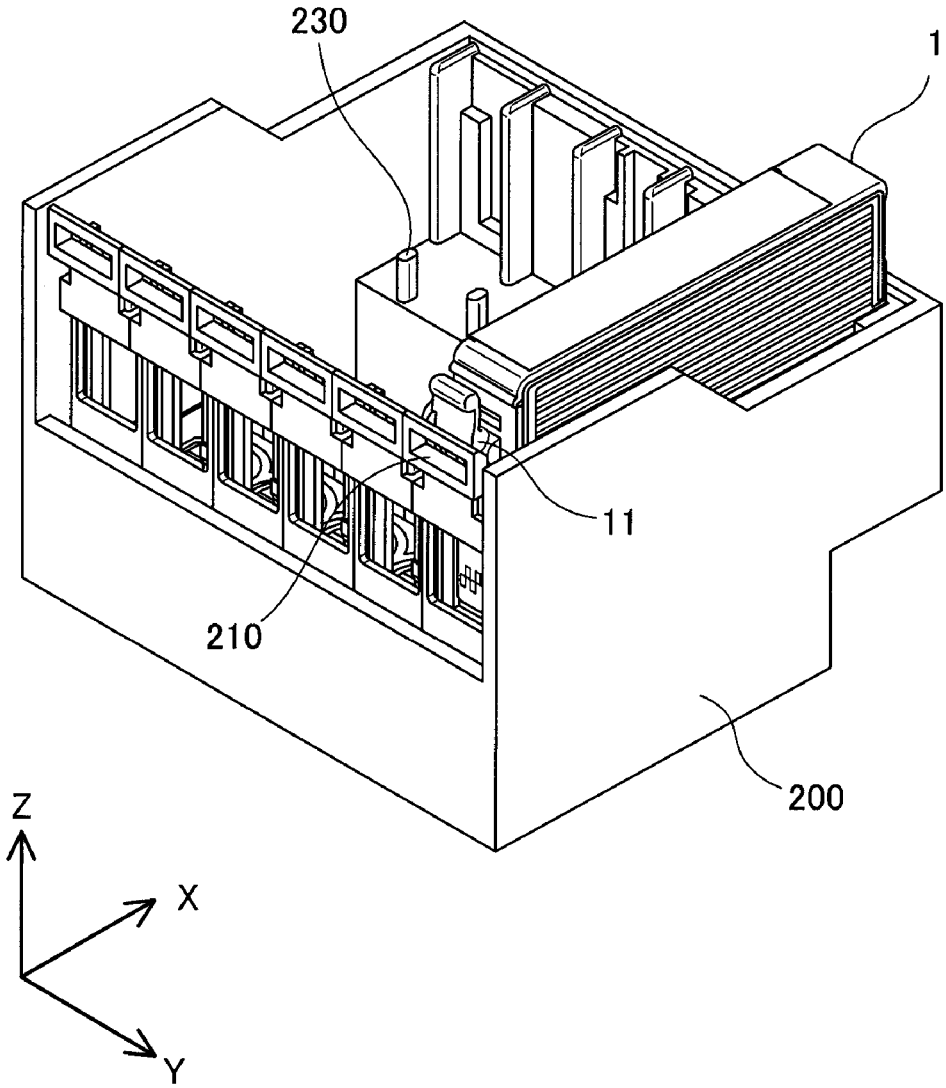
FIG. 5 is an explanatory view showing attachment of the ink cartridge of the embodiment to a carriage.

FIG. 1 is a perspective view showing the front-side appearance of an ink cartridge 1 as a liquid container in one embodiment of the invention. FIG. 2 is a perspective view showing the rear-side appearance of the ink cartridge 1 of the embodiment. FIG. 3 is an exploded perspective view of the ink cartridge 1 of the embodiment seen from the front side corresponding to FIG. 1. FIG. 4 is an exploded perspective view of the ink cartridge 1 of the embodiment seen from the rear side corresponding to FIG. 2. FIG. 5 is an explanatory view showing attachment of the ink cartridge 1 of the embodiment to a carriage 200. In FIGS. 1 through 5, XYZ axes are shown for specifying the attitude (direction) of the ink cartridge.

The ink cartridge 1 stores ink in the liquid form therein. As shown in FIG. 5, the ink cartridge 1 is attached to, for example, the carriage 200 of an ink-jet printer to supply ink to the ink-jet printer. Although the ink cartridge 1 is attached to the carriage 200 (on-carriage structure) in the example of FIG. 5, the ink cartridge 1 may be attached to a separate attachment structure apart from the carriage 200 (off-carriage structure).

As shown in FIGS. 1 and 2, the ink cartridge 1 is formed in a substantially rectangular parallelepiped and has a Z-axis positive direction face 1*a*, a Z-axis negative direction face 1*b*, an X-axis positive direction face 1*c*, an X-axis negative direction face 1*d*, a Y-axis positive direction face 1*e*, and a Y-axis negative direction face 1*f*. In the description hereafter, for the sake of simplicity, the faces 1*a*, 1*b*, 1*c*, 1*d*, 1*e*, and 1*f* may also be respectively referred to as the top face, the bottom face, the right lateral face, the left lateral face, the front face, and the rear face. The sides corresponding to the faces 1*a*, 1*b*, 1*c*, 1*d*,

1*e*, and 1*f* are respectively referred to as the top side, the bottom side, the right side, the left side, the front side, and the rear side.

A liquid feeder 50 is provided on the bottom face 1*b* and has a feed hole for supplying the ink to the ink-jet printer. An air hole 100 open to the air is formed in the bottom face 1*b* to introduce the air into the ink cartridge 1 (see FIG. 4).

The air hole 100 has a specific depth and a specific diameter sufficient to receive one of projections 230 (see FIG. 5), which are provided on the carriage 200 of the ink-jet printer, therein via a predetermined clearance. The user peels off a sealing film 90 that seals the air hole 100 in an air-tight manner and attaches the ink cartridge 1 to the carriage 200. The projections 230 are provided to prevent the user from forgetting to peel off the sealing film 90.

As shown in FIGS. 1 and 2, a catch lever 11 is provided on the left lateral face 1*d*. The catch lever 11 has a projection 11*a*. In attachment of the ink cartridge 1 to the carriage 200, the projection 11*a* is caught in a recess 210 formed in the carriage 200. The ink cartridge 1 is accordingly fastened to the carriage 200 (see FIG. 5). The carriage 200 is an attachment structure where the ink cartridge 1 is attached. In a printing process of the ink-jet printer, the carriage 200 moves integrally with a print head (not shown) back and forth along a width direction of a printing medium (a main scanning direction shown as a Y-axis direction in FIG. 5).

A circuit board 35 is provided below the catch lever 11 on the left lateral face 1*d* (see FIG. 2). The circuit board 35 has multiple electrode terminals 35*a*, which are electrically connected with the ink-jet printer via corresponding electrode terminals (not shown) on the carriage 200.

An outer surface film 60 is applied on the top face 1*a* and on the rear face 1*f* of the ink cartridge 1.

Referring to FIGS. 3 and 4, the internal structure and the respective part structures of the ink cartridge 1 are explained in detail. The ink cartridge 1 has a cartridge body 10 and a casing member 20 covering the front face of the cartridge body 10.

Ribs 10*a* in various shapes are formed on the front face of the cartridge body 10 (see FIG. 3). A film 80 is provided between the cartridge body 10 and the casing member 20 to cover the front face of the cartridge body 10. The film 80 is closely applied onto the cartridge body 10 such as to make no spaces from the respective front ends of the ribs 10*a* on the cartridge body 10. The ribs 10*a* and the film 80 define multiple small chambers including an end chamber and a buffer chamber discussed later inside the ink cartridge 1.

A differential pressure regulator chamber 40*a* and a gas liquid separation chamber 70*a* are formed on the rear face of the cartridge body 10 (FIG. 4). The differential pressure regulator chamber 40*a* receives a differential pressure regulator 40 including a valve member 41, a spring 42, and a spring washer 43. The gas liquid separation chamber 70*a* has a step 70*b* formed around an inner wall surrounding a bottom face. A gas liquid separating film 71 is attached to the step 70*b*. The gas liquid separating film 71 in combination with the gas liquid separation chamber 70*a* and the step 70*b* forms a gas liquid separation filter 70.

Multiple grooves 10*b* are formed on the rear face of the cartridge body 10 (see FIG. 4). In application of the outer surface film 60 to cover over the substantially whole rear face of the cartridge body 10, these multiple grooves 10*b* form various flow paths (discussed later), for example, flow paths for ink and the air, between the cartridge body 10 and the outer surface film 60.

The peripheral structure of the circuit board 35 is described. A sensor chamber 30*a* is formed in a lower area of the right lateral face of the cartridge body 10 (see FIG. 4). A liquid level sensor 31 is placed in the sensor chamber 30*a* and is stuck by a film 32. The opening of the sensor chamber 30*a* on the right lateral face is covered with a cover member 33. The circuit board 35 is fixed to an outer surface 33*a* of the cover member 33 via a trunk terminal 34. The liquid level sensor 31 in combination with the sensor chamber 30*a*, the film 32, the cover member 33, the trunk terminal 34, and the circuit board 35 constitutes a detector (sensor unit) 30.

The liquid level sensor 31 has a cavity arranged to form part of an ink fluid assembly (discussed later), a diaphragm arranged to form part of wall surface of the cavity, and a piezoelectric element located on the diaphragm. The detailed structure of the liquid level sensor 31 is not specifically illustrated. A terminal of the piezoelectric element is electrically connected with part of the electrode terminals 35*a* on the circuit board 35. In attachment of the ink cartridge 1 to the ink-jet printer, the terminal of the piezoelectric element is electrically connected with the ink-jet printer via the electrode terminal 35*a* of the circuit board 35. The ink-jet printer gives electrical energy to the piezoelectric element to vibrate the diaphragm via the piezoelectric element. The ink-jet printer detects the residual vibration characteristic (for example, the frequency) of the diaphragm via the piezoelectric element, so as to identify the presence or the absence of ink in the cavity. The frequency of the diaphragm (the frequency of a detection signal) is varied by the presence or the absence of ink in the cavity. The frequency of the diaphragm is thus utilized to identify the presence or the absence of ink in the cavity. Consumption of the ink stored in the cartridge body 10 changes the internal state of the cavity from the ink filling state to the air filling state. This leads to a change of the residual vibration characteristic of the diaphragm. The change of the residual vibration characteristic is detected by the liquid level sensor 31. Based on the detection, the ink-jet printer identifies the presence or the absence of the ink in the cavity and determines whether ink remains in the ink cartridge 1.

The circuit board 35 has a rewritable non-volatile memory, such as an EEPROM (electronically erasable and programmable read only memory), to record the remaining amount or the consumed amount of ink and the ink type in the ink cartridge 1 and the date of manufacture of the ink cartridge 1.

A decompression hole 110 is provided, together with the liquid feeder 50 and the air hole 100 mentioned above, on the bottom face of the cartridge body 10 (see FIG. 4). The decompression hole 110 is used to suck out the air and depressurize the inside of the ink cartridge 1 at an ink filling step in a manufacturing process of the ink cartridge 1.

Immediately after manufacture of the ink cartridge 1, the liquid feeder 50, the air hole 100, and the decompression hole 110 are respectively sealed with sealing films 54, 90, and 98. The sealing film 90 is peeled off by the user, prior to attachment of the ink cartridge 1 to the carriage 200 of the ink-jet printer as explained previously. The peel-off of the sealing film 90 makes the air hole 100 communicates with the outside air to allow introduction of the air into the ink cartridge 1. In the state of attachment of the ink cartridge 1 to the carriage 200 of the ink-jet printer, the sealing film 54 is broken by an ink supply needle 240 (see FIG. 6) provided on the carriage 200.

A seal member 51, a spring washer 52, and a closing spring 53 are provided inside the liquid feeder 50 to be arranged in this order from the bottom side. In insertion of the ink supply needle 240 into the liquid feeder 50, the seal member 51 seals the liquid feeder 50 to make no clearance between the inner wall of the liquid feeder 50 and the outer wall of the ink supply needle 240. In the state of no attachment of the ink cartridge 1 to the carriage 200, the spring washer 52 comes into contact with the inner wall of the seal member 51 to close the liquid feeder 50. The closing spring 53 presses the spring washer 52 in a specific direction to bring the spring washer 52 into contact with the inner wall of the seal member 51. In insertion of the ink supply needle 240 on the carriage 200 into the liquid feeder 50, an upper edge of the ink supply needle 240 presses up the spring washer 52 to make a clearance between the spring washer 52 and the seal member 51. A supply of ink is fed to the ink supply needle 240 through this clearance.

Figure 6:
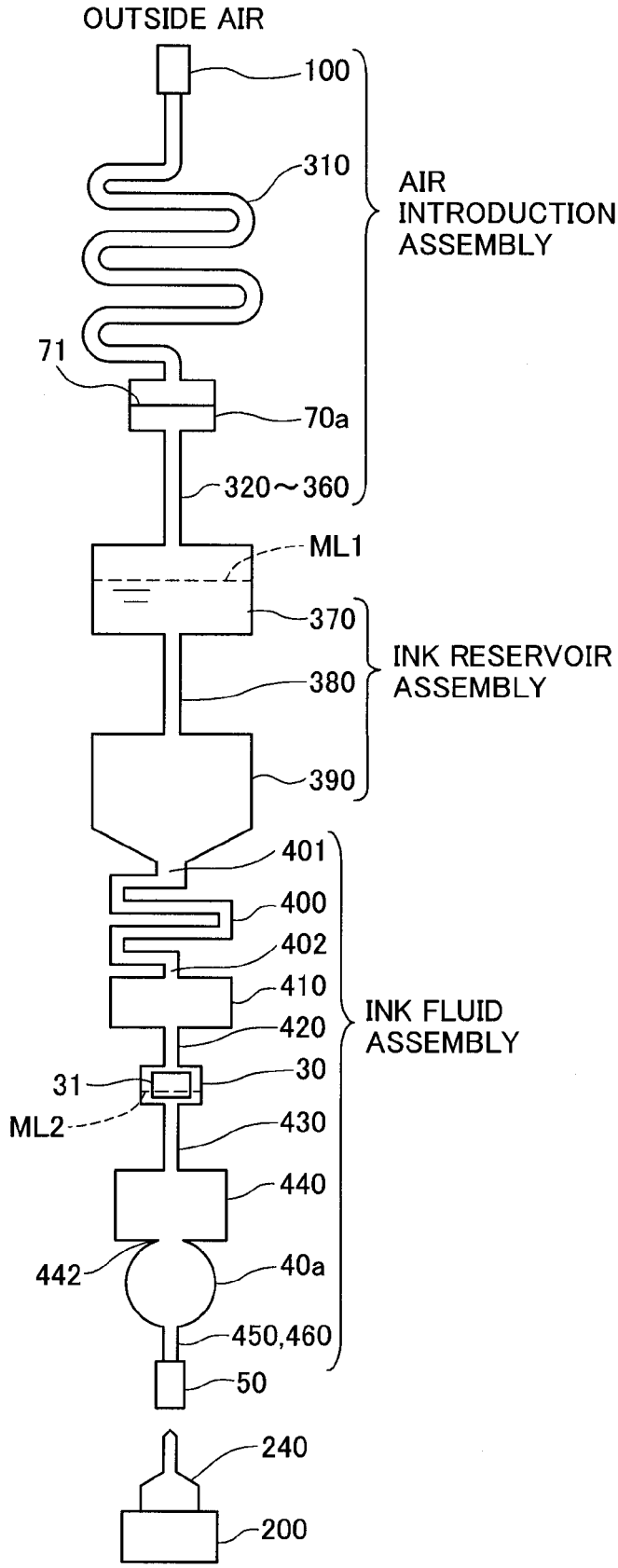
FIG. 6 is a conceptive view showing pathway from an air hole to a liquid feeder.

Prior to the detailed explanation of the internal structure of the ink cartridge 1, for the better understanding, the pathway from the air hole 100 to the liquid feeder 50 is conceptually discussed with reference to FIG. 6. FIG. 6 is a conceptive view showing the pathway from the air hole 100 to the liquid feeder 50.

The pathway from the air hole 100 to the liquid feeder 50 is roughly divided into an ink reservoir assembly for storage of ink, an air introduction assembly (air communicating assembly) provided in the upstream of the ink reservoir assembly, and an ink fluid assembly provided in the downstream of the ink reservoir assembly.

The ink reservoir assembly has a tank chamber 370 as a first liquid reservoir, a chamber-to-chamber communicating path 380 (corresponding to the second communicating path in the claims of the invention), and an end chamber 390 as a second liquid reservoir, which are arranged in this order from the upstream to the downstream. Instead of the first and the second liquid reservoirs or instead of the tank chamber 370 and the end chamber 390, only one integral liquid reservoir may be provided or three or a greater number of liquid reservoirs may be provided. In general, division of the liquid reservoir into multiple chambers desirably reduces (absorbs) the influence of a volume change of the air incorporated in the liquid reservoir due to, for example, an environmental temperature variation. The chamber-to-chamber communicating path 380 has an upstream end connecting with the tank chamber 370 and a downstream end connecting with the end chamber 390.

The air introduction assembly has a serpentine path 310, the gas liquid separation chamber 70*a* provided to receive the gas liquid separating film 71 therein as discussed above, and air chambers 320 to 360 (corresponding to the third communicating path in the claims of the invention) formed to connect the gas liquid separation chamber 70*a* to the ink reservoir assembly, which are arranged in this order from the upstream to the downstream. The air introduction assembly works as the air communicating assembly to make the ink reservoir assembly communicate with the outside air. The serpentine path 310 has an upstream end connecting with the air hole 100 and a downstream end connecting with the gas liquid separation chamber 70*a*. The serpentine path 310 meanders to extend the length from the air hole 100 to the ink reservoir assembly. This arrangement desirably prevents vaporization of the water content in the ink in the ink reservoir assembly. The gas liquid separating film 71 is made of a specific material that allows transmission of gas but prohibits transmission of liquid. The gas liquid separating film 71 is provided between the upstream side and the downstream side of the gas liquid separation chamber 70*a*. This arrangement aims to prevent the backflow of the ink from the ink reservoir assembly from flowing into the upstream of the gas liquid separation chamber 70*a*. The detailed structure of the air chambers 320 to 360 will be discussed later.

The ink fluid assembly has a vertical communicating path 400 (corresponding to the first communicating path in the claims of the invention), a bubble separation chamber 410, a first fluid path 420, the sensor unit 30 (mentioned above), a second fluid path 430, a buffer chamber 440, the differential pressure regulator chamber 40*a* provided to receive the differential pressure regulator 40 therein as discussed above, a third fluid path 450, and a fourth fluid path 460, which are arranged in this order from the upstream to the downstream.

Figure 7:
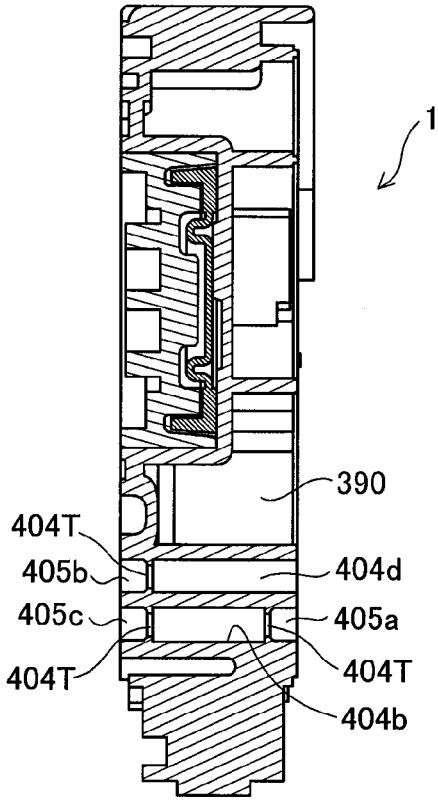
FIG. 7 is a sectional view showing the ink cartridge of the embodiment taken on a line 7-7 in FIG. 11.
Figure 8:
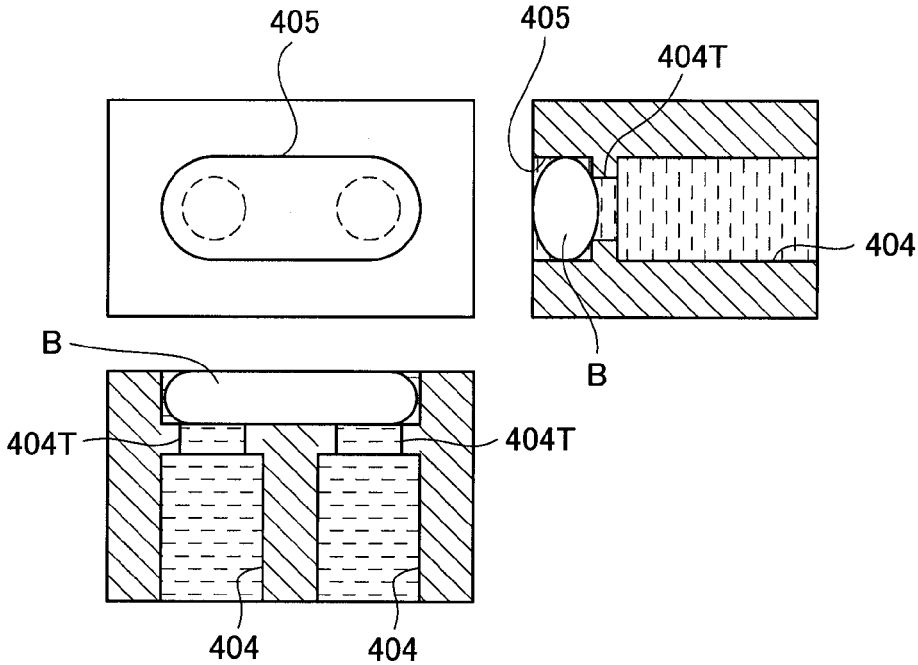
FIG. 8 is an explanatory view showing the characteristics of a vertical communicating path in the ink cartridge of the embodiment.
Figure 9:
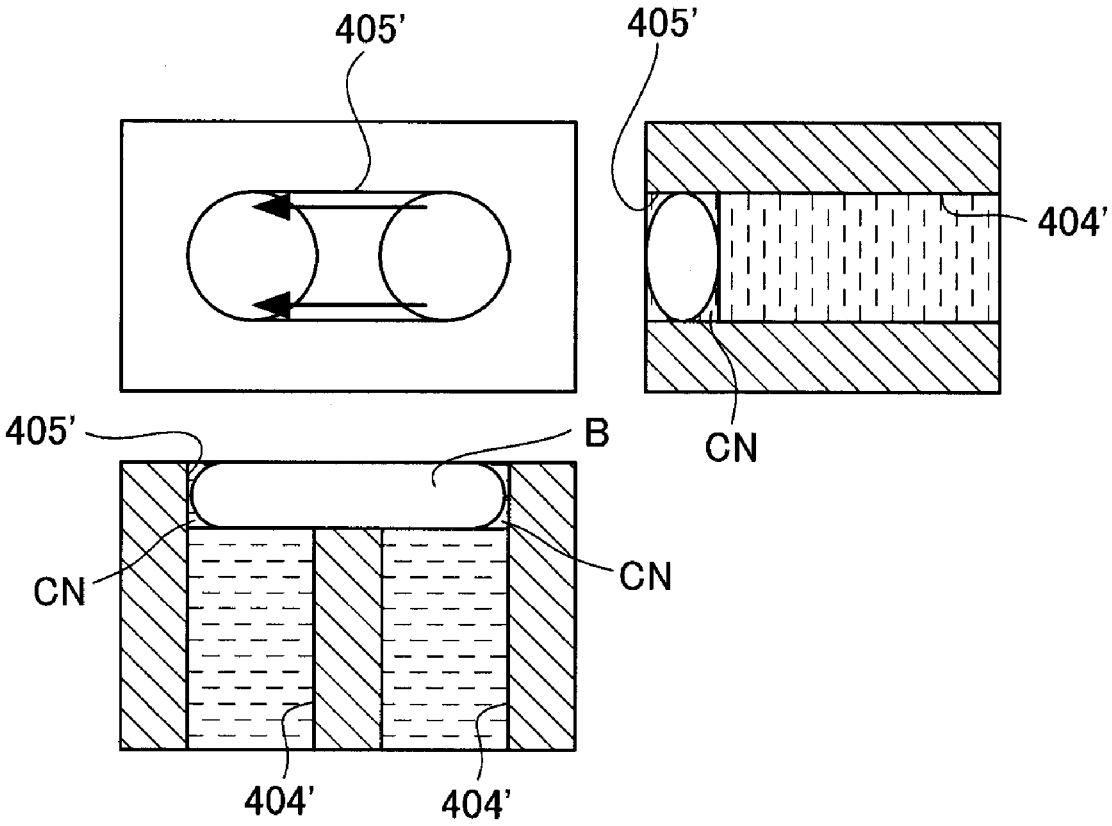
FIG. 9 is an explanatory view showing the structure of a comparative example for explaining the characteristics of the vertical communicating path of the embodiment.
Figure 10:
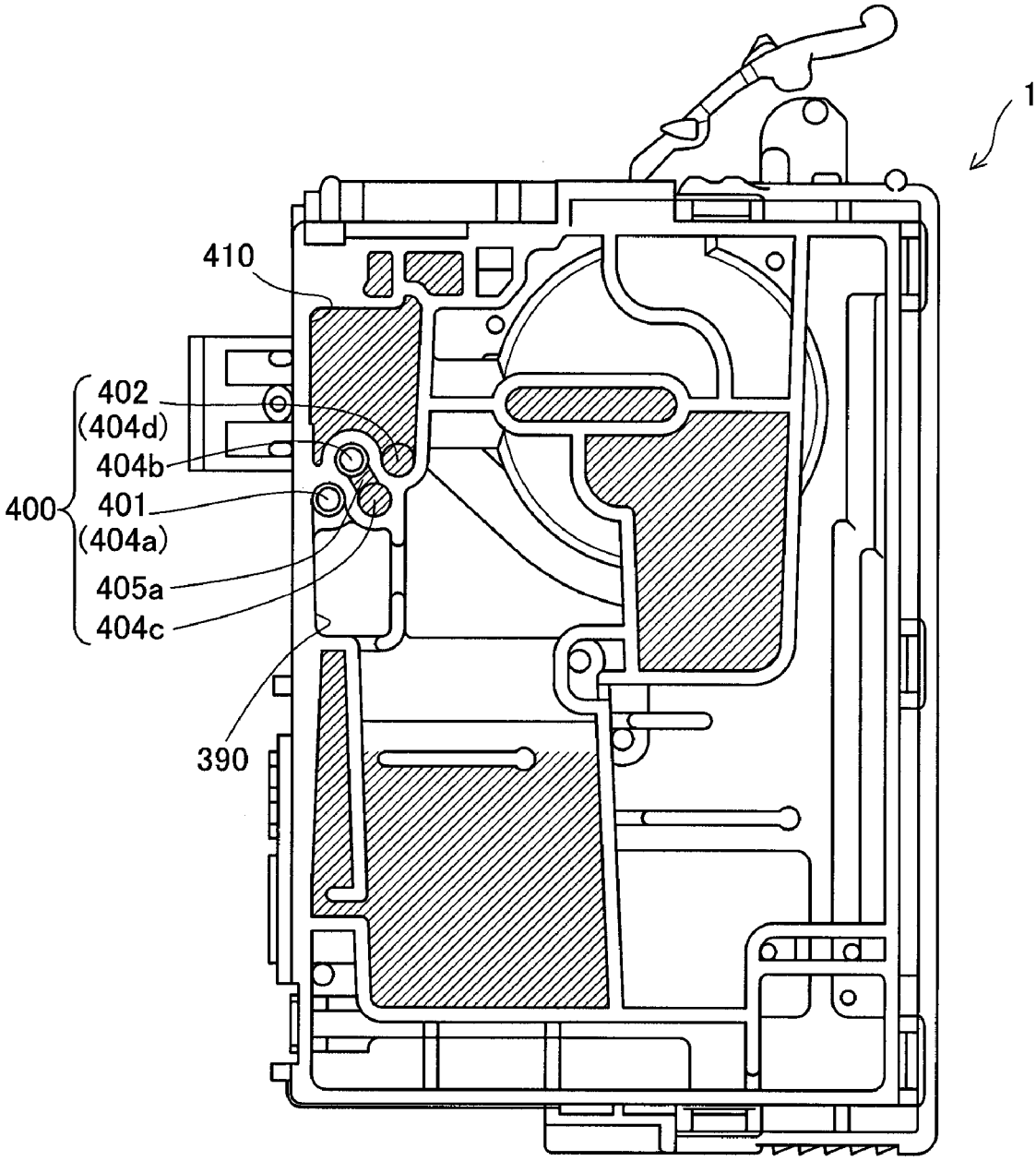
FIG. 10 is an explanatory view showing the characteristics of the vertical communicating path involved in the attitude of the ink cartridge of the embodiment.

The vertical communicating path 400 has sterically-arranged multiple bends and is formed in a turndown step shape. The detailed structure of the vertical communicating path 400 is discussed with reference to FIGS. 7 through 10. FIG. 7 is a sectional view showing the ink cartridge 1 of the embodiment taken on a line 7-7 in FIG. 11. FIG. 8 is an explanatory view showing the characteristics of the vertical communicating path 400 in the ink cartridge 1 of the embodiment. FIG. 9 is an explanatory view showing the structure of a comparative example for explaining the characteristics of the vertical communicating path 400 of the embodiment. FIG. 10 is an explanatory view showing the characteristics of the vertical communicating path 400 involved in the attitude of the ink cartridge 1 of the embodiment.

The vertical communicating path 400 has four cylindrical flow paths 404, a first cylindrical flow path 404*a* to a fourth cylindrical flow path 404*d*, and three connecting flow paths 405, a first connecting flow path 405*a* to a third connecting flow path 405*c*. The respective cylindrical flow paths 404*a* to 404*d* are formed perpendicular to the vertical direction (see FIG. 8) and are arranged in zigzag in the vertical direction (see FIG. 11). The four cylindrical flow paths 404*a* to 404*d* are formed in parallel with the bottom face of the ink cartridge 1 to be extended in a depth direction (Y direction) and are arranged at different heights in the vertical direction (height direction). In the structure of this embodiment, the four cylindrical flow paths 404*a* to 404*d* are divided into two groups overlapping in the vertical direction. The first group includes the first cylindrical flow path 404*a* and the third cylindrical flow path 404*c*. The second group includes the second cylindrical flow path 404*b* and the fourth cylindrical flow path 404*d*. The heights of the first cylindrical flow path 404*a* to the fourth cylindrical flow path 404*d* in the vertical direction gradually increase in this sequence.

Each of the connecting flow paths 405 is extended obliquely upward and interconnects the two cylindrical flow paths 404 on both the lateral faces of the ink cartridge 1, so as to form the vertical communicating path 400 as one integral communicating path from an inlet 401 to an outlet 402. On the lateral face of the ink cartridge 1 with the two connecting flow paths 405 arranged thereon, the two connecting flow paths 405 respectively connecting the two cylindrical flow paths 404 are arranged in parallel to each other. On the first lateral face (the side shown in FIG. 11), one end of the second cylindrical flow path 404*b* is connected with one end of the third cylindrical flow path 404*c* by the first connecting flow path 405*a*. On the second lateral face (the side shown in FIG. 12), the other end of the first cylindrical flow path 404*a* is connected with the other end of the second cylindrical flow path 404*b* by the second connecting flow path 405*b*. The other end of the third cylindrical flow path 404*c* is connected with the other end of the fourth cylindrical flow path 404*d* by the third connecting flow path 405*c*. This forms the vertical communicating path 400 in a turndown step shape (or in a spiral shape) from the inlet 401 toward the outlet 402. The first connecting flow path 405*a* to the third connecting flow path 405*c* in combination with the outer surface film 60 and the film 80 define flow passages. The first connecting flow path 405*a* to the third connecting flow path 405*c* are thus also called first through third connecting flow path-forming elements. Each of the first connecting flow path 405*a* to the third connecting flow path 405*c* is preferably formed to have a semicircular cross section or a curved cross section without any edge. The presence of the edge causes clearances between the edge and the curvature of bubbles, which interfere with effective ink sealing.

The structure of the vertical communicating path 400 discussed above effectively prevents migration of bubbles into the bubble separation chamber 410, which is caused by a change of external environment, for example, a variation of the ambient temperature or a variation of the outside atmospheric pressure. For example, in an ink-freezing environment at decreased ambient temperature, ink filled in the bubble separation chamber 410 increases its volume and flows into the end chamber 390. The ink decreases its volume to the original level when being unfrozen. The ink may be unfrozen in the state where an inlet of the bubble separation chamber 410 is in contact with the air in the end chamber 390 according to the attitude of the ink cartridge 1. In this state, the air in the end chamber 390 may flow into the bubble separation chamber 410 to form bubbles in the bubble separation chamber 410. In the structure of the embodiment, the vertical communicating path 400 is designed to have a greater volume than the increased volume of frozen ink filled in a space between the bubble separation chamber 410 and the buffer chamber 440. This arrangement effectively makes the unfrozen ink remain in the vertical communicating path 400 and thereby controls or prevents migration of the air (bubbles) into the bubbler separation chamber 410.

In the structure of the embodiment, each of the cylindrical flow paths 404 has a constriction 404T having a smaller diameter than the flow path diameters of the residual part of the cylindrical flow path 404 and the connecting flow path 405 at each end connecting with the connecting flow path 405 as shown in FIGS. 7 and 8. The constriction 404T prevents or reduces the ink flow from the connecting flow path 405 to the cylindrical flow path 404. The flow path diameter of the residual part of the cylindrical flow path 404 may be identical with or may be smaller than (or greater than) the flow path diameter of the connecting flow path 405.

In the structure of a cylindrical flow path without any constriction shown as a comparative example in FIG. 9, in the presence of a bubble B in a connecting flow path 405', a cylindrical flow path 404' communicates with the connecting flow path 405' via a clearance CN formed between the curvature of the bubble B and the connecting flow path 405'. Such communication allows ink to flow between the end chamber 390 and the bubble separation chamber 410 across the clearance CN. The ink flows out toward the end chamber 390 under application of a pressure from the downstream (that is, from the side of the bubble separation chamber 410). The bubble B does not move during the ink flow across the clearance CN and is gradually accumulated with other bubbles B moving from the upstream to the downstream. The bubbles accordingly tend to accumulate in the vertical communicating path 400.

In the structure of the cylindrical flow path 404 with the constriction 404T shown in FIG. 8, on the other hand, the constriction 404T has the smaller diameter than the flow path diameters of the residual part of the cylindrical flow path 404 and the connecting flow path 405. A bubble B entering the connecting flow path 405 accordingly has the greater diameter than the diameter of the constriction 404T of the cylindrical flow path 404. The constriction 404T interferes with communication of clearances formed between the curvature of the bubble B and the connecting flow path 405 with the cylindrical flow path 404. The cylindrical flow path 404 is accordingly sealed by the bubble B. The bubble B flowing into the connecting flow path 405 is pressed against the upstream cylindrical flow path 404 under application of a pressure from the downstream. The cylindrical flow path 404 (with the constriction 404T) is thus sealed with the bubble B. This arrangement does not allow ink to be flowed between the end chamber 390 and the bubble separation chamber 410 and thereby controls or prevents the outflow of ink to the end chamber 390.

The vertical communicating path 400 is structured such as to allow migration of bubbles into the bubble separation chamber 410 only in the event of moving the bubbles in the direction of gravity at any attitude of the ink cartridge 1 other than the normal attitude in attachment to the ink-jet printer or other than the attitude with the bottom of the ink cartridge 1 facing down as shown in FIG. 10.

In the vertical communicating path 400, the first connecting flow path 405*a* and the third connecting flow path 405*c* are arranged in a V shape at the attitude of the ink cartridge 1 shown in FIG. 10. In general, the vertical communicating path 400 has at least a connecting flow path A extended obliquely downward (in a first direction) relative to the vertical direction from the bubble separation chamber 410 and a connecting flow path B arranged to connect with the connecting flow path A and extended obliquely downward (in a second direction) that is axisymmetric with the connecting flow path A.

The structure of the vertical communicating path 400 effectively controls or prevents migration (flow) of bubbles into the bubble separation chamber 410 at any attitude of the ink cartridge 1 detached from the ink-jet printer. At the attitude of the ink cartridge 1 attached to the ink-jet printer, the inlet 401 of the vertical communicating path 400 located at the lower-most position of the end chamber 390 is not exposed to the air. No bubble accordingly flows through the vertical communicating path 400. At any other attitude of the ink cartridge 1, the vertical communicating path 400 is designed to allow migration of bubbles into the bubble separation chamber 410 only in the event of moving bubbles in the direction of gravity. This actually interferes with migration of bubbles. The structure of the vertical communicating path 400 thus effectively controls or prevents migration of bubbles from the vertical communicating path 400 into the bubble separation chamber 410 at any attitude of the ink cartridge 1.

The bubble separation chamber 410 communicates with the first fluid path 420 via a communication hole 412 formed in the bubble separation chamber 410. The first fluid path 420 has a downstream end connecting with the sensor unit 30. The bubble separation chamber 410 separates bubbles included in the ink flowed in from the vertical communicating path 400 and thereby controls or prevents migration of bubbles into the sensor unit 30. The bubble separation chamber 410 is designed to allow the inflow of ink via the outlet 402 from the vertical communicating path 400 located above the bubble separation chamber 410 (in a Z direction) and the outflow of ink via the second fluid path 430 located below the bubble separation chamber 410 toward the sensor unit 30. This structure of the bubble separation chamber 410 causes the bubble (air)-incorporated ink flowed in from the vertical communicating path 400 to be separated into a gas component (the air content in the ink) remaining in the upper portion of the bubble separation chamber 410 and a liquid component (ink) moving down along the inner wall surface of the bubble separation chamber 410 to the lower portion of the bubble separation chamber 410. The bubbles are trapped in the upper portion of the bubble separation chamber 410 by utilizing the difference of the specific gravity between the gas component and the liquid component. The bubbles are naturally not formed in the absence of either the air or the ink. Separation of the air from the ink thus effectively controls or prevents migration of bubbles into the sensor unit 30 and thereby decreases or substantially eliminates the potential for false detection by the liquid level sensor 31. The bubbles migrated into the sensor unit 30 may cause the liquid level sensor 31 to falsely detect the out-of-ink although the ink actually remains in the ink cartridge 1. When substantially no ink remains in the ink cartridge 1, suction of a very little amount of remaining ink with the air as a bubble-incorporated liquid into the sensor unit 30 by the capillarity may cause the liquid level sensor 31 to falsely detect the presence of the ink. In the former case, the ink-jet printer does not perform printing irrespective of the presence of ink in the ink cartridge 1. In the latter case, the ink-jet printer performs printing irrespective of the absence of ink in the ink cartridge 1. This may damage a print head.

The second fluid path 430 has an upstream end connecting with the sensor unit 30 and a downstream end connecting with the buffer chamber 440. A stirrer ball may be provided inside the buffer chamber 440. The motions of the stirrer ball caused by the ink flow and the reciprocating motions of the carriage 200 in the main scanning direction stir the ink in the buffer chamber 440 to prevent sedimentation of some components of the ink and keep the uniformity of ink. The buffer chamber 440 has a communication hole 442 and communicates with the differential pressure regulator chamber 40*a* not across any flow path formed therebetween but directly via the communication hole 442. This arrangement reduces the space from the buffer chamber 440 to the liquid feeder 50 and decreases the potential for ink accumulation and sedimentation. The differential pressure regulator 40 located in the differential pressure regulator chamber 40*a* regulates the pressure of the ink in the downstream of the differential pressure regulator chamber 40*a* to be lower than the pressure of the ink in the upstream and causes the ink to have a negative pressure in the downstream. This pressure regulation effectively prevents the backflow of the ink. The third fluid path 450 has an upstream end connecting with the differential pressure regulator chamber 40*a* and a downstream end connecting with the liquid feeder 50.

In manufacture of the ink cartridge 1, ink is filled to the tank chamber 370. The liquid level of the ink (gas liquid interface) in this state is conceptually shown as a broken line ML1 in FIG. 6. As the ink stored in the ink cartridge 1 is gradually consumed by the ink-jet printer, the ink moves in the downstream, while the air introduced through the air hole 100 flows from the upstream into the ink cartridge 1. The liquid level of the ink is gradually lowered downward in the vertical direction. With further consumption of ink, the gas liquid interface reaches the sensor unit 30. The liquid level of the ink in this state is conceptually shown as a broken line ML2 in FIG. 6.

Such migration of the air into the sensor unit 30 is detected as the out-of-ink by the liquid level sensor 31. As mentioned previously, the liquid level sensor 31 outputs detection result signals of different signal waveforms (resonance frequencies) in the presence of the air and in the absence of the air in the sensor unit 30 (that is, the bubble-incorporated state and the liquid-filling state). In response to detection of the out-of-ink based on the detection result signal, the ink-jet printer stops printing at a stage prior to complete consumption of the ink present in the downstream of the sensor unit 30 (for example, the buffer chamber 440) in the ink cartridge 1 and informs the user of the out-of-ink. Continued printing in the complete out-of-ink condition may cause the air to be migrated into the print head and damage the print head by the blank hit.

Figure 11:
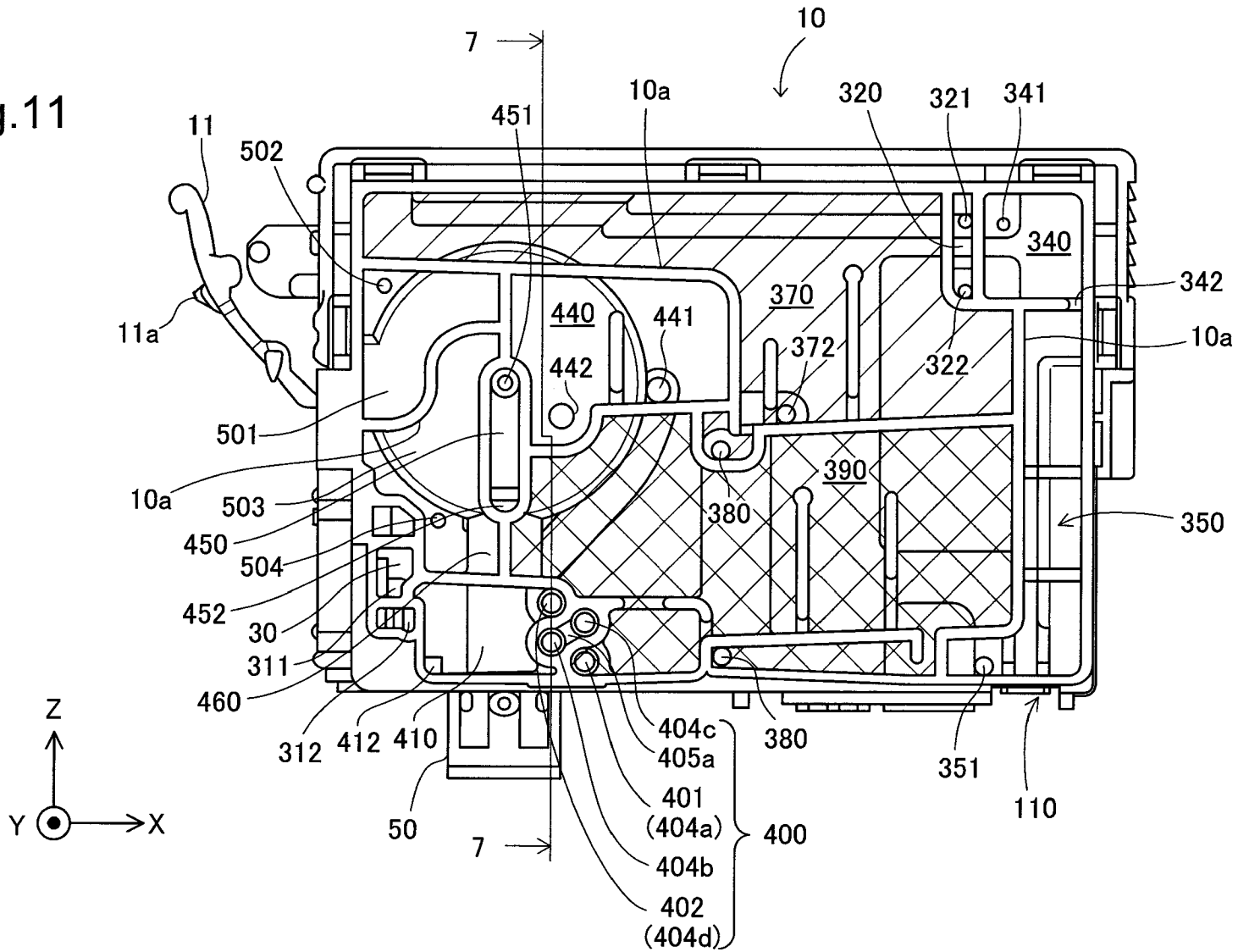
FIG. 11 is a front view showing a cartridge body in the ink cartridge of the embodiment.
Figure 12:
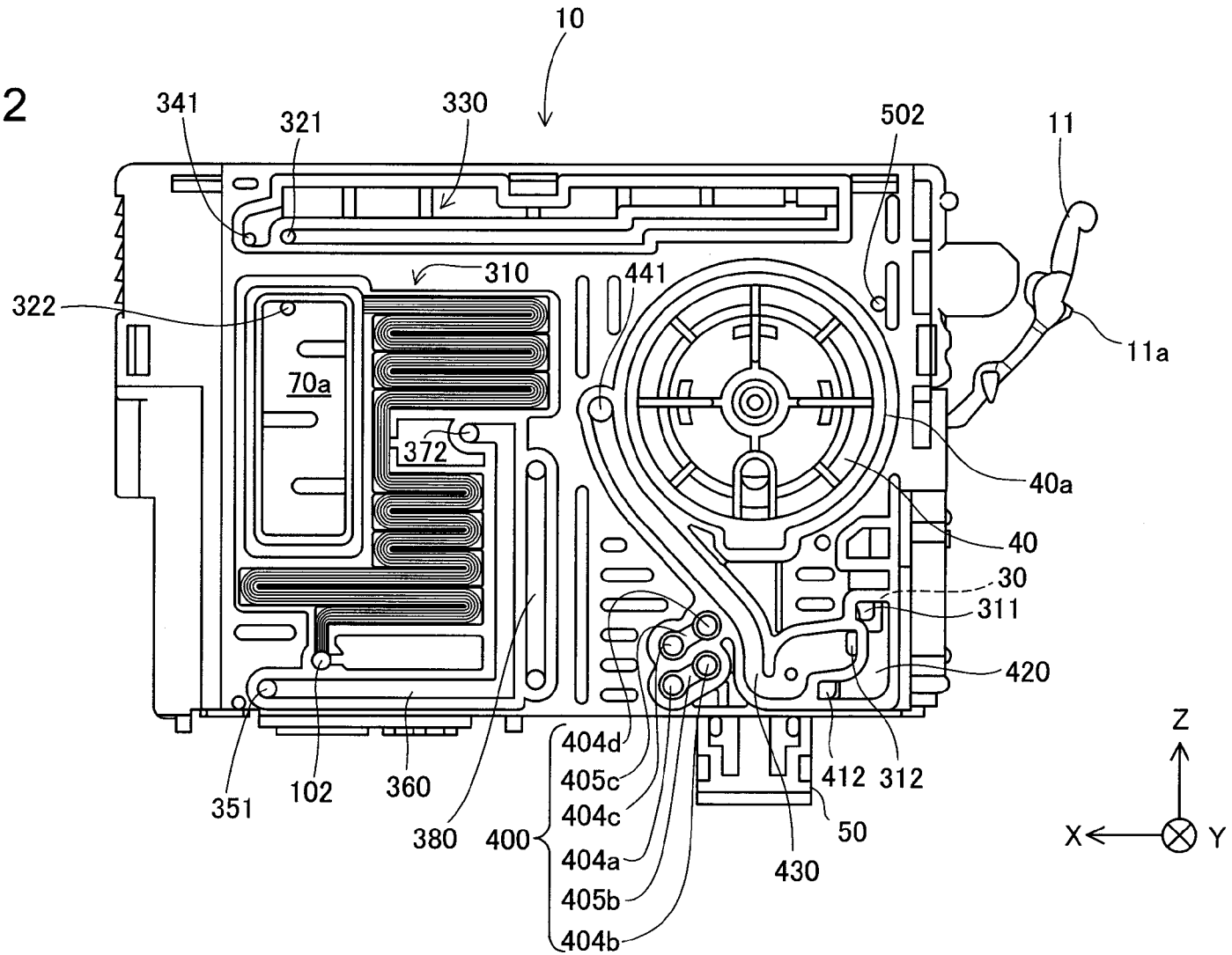
FIG. 12 is a rear view showing the cartridge body in the ink cartridge of the embodiment.
Figure 13A:
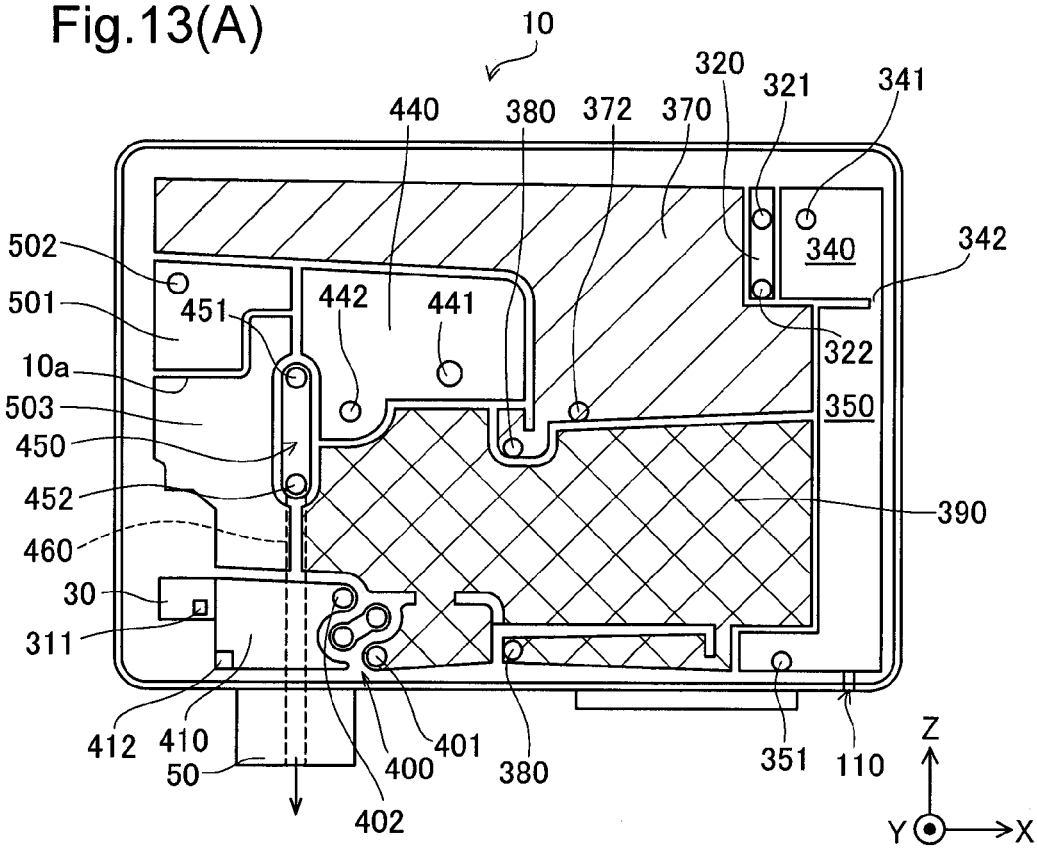
FIGS. 13(*a*) and 13(*b*) are partly-omitted simplified views showing the structure of FIG. 11 and the structure of FIG. 12.
Figure 13B:
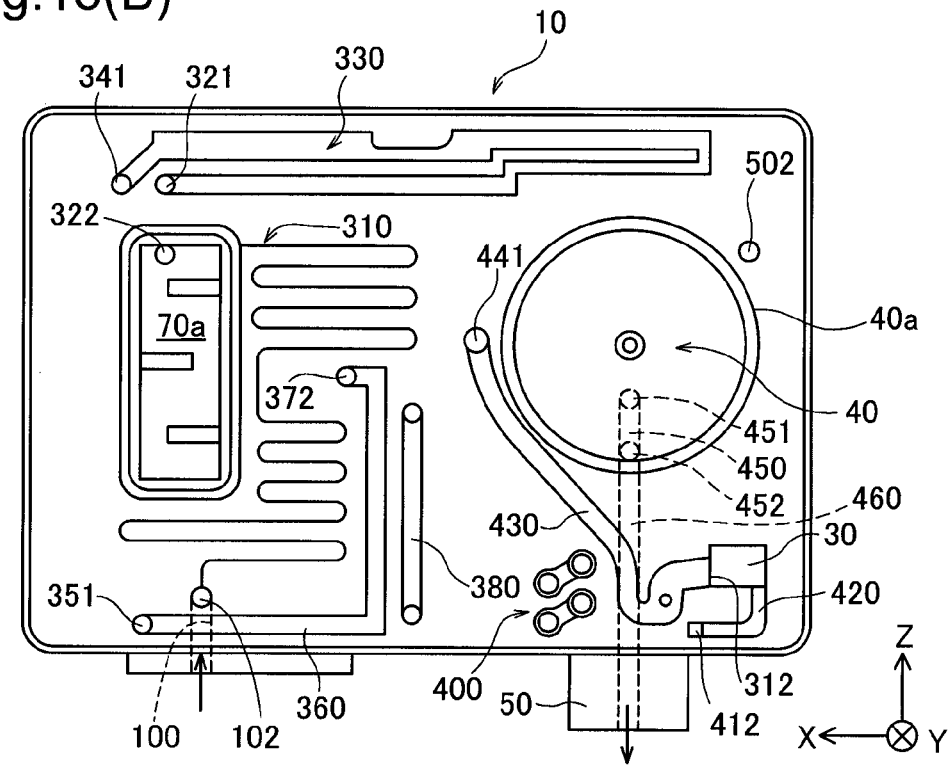

On the basis of the above discussion, the concrete structures of the respective components of the ink cartridge 1 in the pathway from the air hole 100 to the liquid feeder 50 are described with reference to FIGS. 11 through 13. FIG. 11 is a front view showing the cartridge body 10 of the ink cartridge 1. FIG. 12 is a rear view showing the cartridge body 10 of the ink cartridge 1. FIG. 13(*a*) is a partly-omitted simplified view showing the structure of FIG. 11, and FIG. 13(*b*) is a partly-omitted simplified view showing the structure of FIG. 12.

The tank chamber 370 and the end chamber 390 of the ink reservoir assembly are provided on the front face of the cartridge body 10. The tank chamber 370 and the end chamber 390 are shown as a single hatched area and a cross hatched area in FIGS. 11 and 13(*a*). The tank chamber 370 is formed between the air hole 100 and the liquid feeder 50 to be located immediately below the top face (plane) of the cartridge body 10, that is, in an upper portion or an uppermost portion of the cartridge body 10. The end chamber 390 is formed between the air hole 100 and the liquid feeder 50 to be located immediately above the bottom face of the cartridge body 10, that is, in a lower portion or a lowermost portion of the cartridge body 10. The chamber-to-chamber communicating path 380 is formed in a center portion on the rear face of the cartridge body 10 as shown in FIGS. 12 and 13(*b*). The chamber-to-chamber communicating path 380 connects the tank chamber 370 with the end chamber 390 and has the upstream end connecting with the tank chamber 370 and the downstream end connecting with the end chamber 390. The upstream end of the chamber-to-chamber communicating path 380 (with a communication hole 381 as discussed later) is located at a specific position close to the lowermost side of the tank chamber 370 (see FIGS. 11 and 13(*a*)).

The serpentine path 310 and the gas liquid separation chamber 70*a* of the air introduction assembly are formed in a specific area close to the right side on the rear face of the cartridge body 10 as shown in FIGS. 12 and 13(*b*). A communication hole 102 is formed to connect the upstream end of the serpentine path 310 with the air hole 100. The downstream end of the serpentine path 310 passes through the side wall of the gas liquid separation chamber 70*a* to communicate with the gas liquid separation chamber 70*a*.

Among the first to the fifth air chambers 320 to 360 of the air introduction assembly shown in FIG. 6, the first air chamber 320, the third air chamber 340, and the fourth air chamber 350 are provided on the front face of the cartridge body 10 (see FIGS. 11 and 13(*a*)), whereas the second air chamber 330 and the fifth air chamber 360 are provided on the rear face of the cartridge body 10 (see FIGS. 12 and 13(*b*)). The first to the fifth air chambers 320 to 360 are arranged in series in this sequence from the upstream to the downstream to form one flow path. The air chambers 320 and 330 are formed immediately below the top face 1*a* of the cartridge body 10. The air chambers 340 and 350 are formed immediately below the side face 1*c* of the cartridge body 10. A communication hole 322 is formed to connect the gas liquid separation chamber 70*a* with the air chamber 320. Communication holes 321 and 341 are respectively formed to connect the air chamber 320 with the air chamber 330 and to connect the air chamber 330 with the air chamber 340. The air chambers 340 and 350 are interconnected via a cutout 342 formed in a rib parting the air chamber 340 from the air chamber 350. Communication holes 351 and 372 are respectively formed to connect the air chamber 350 with the air chamber 360 and to connect the air chamber 360 with the tank chamber 370. The sterical arrangement of the mutually parted first through fifth air chambers 320 to 360 effectively prevents the backflow of ink from the tank chamber 370 to the gas liquid separation chamber 70*a*.

The vertical communicating path 400 and the bubble separation chamber 410 of the ink fluid assembly are provided at a specific position close to the liquid feeder 50 on the front face of the cartridge body 10 as shown in FIGS. 11 and 13(*a*). The vertical communicating path 400 has an inlet 401 connecting with a lower-most end of the end chamber 390 and an outlet 402 connecting with an upper-most end of the bubble separation chamber 410. The vertical communicating path 400 is extended back and forth twice along the width between the rear face and the front face of the cartridge body 10 to connect the end chamber 390 with the bubble separation chamber 410. The sensor unit 30 is located at a specific position close to the bottom side on the left lateral face of the cartridge body 10 as mentioned previously with reference to FIG. 4 (see FIGS. 11 through 13).

The first fluid path 420 connecting the bubble separation chamber 410 with the sensor unit 30 and the second fluid path 430 connecting the sensor unit 30 with the buffer chamber 440 are formed on the rear face of the cartridge body 10 as shown in FIGS. 12 and 13(*b*). A communication hole 412 is formed on the bottom face of the bubble separation chamber 410 to connect the bubble separation chamber 410 with the first fluid path 420. A communication hole 311 is formed to connect the first fluid path 420 with the sensor unit 30. Communication holes 312 and 441 are formed respectively to connect the sensor unit 30 with the second fluid path 430 and to connect the second fluid path 430 with the buffer chamber 440.

The buffer chamber 440, the third fluid path 450, and the fourth fluid path 460 are formed in a specific area close to the left side on the front face of the cartridge body 10 as shown in FIGS. 11 and 13(*a*). The communication hole 441 is formed to connect a downstream end of the second fluid path 430 with the buffer chamber 440. The communication hole 442 is formed on the bottom face of the buffer chamber 440 to directly connect the buffer chamber 440 with the differential pressure regulator chamber 40*a*. A communication hole 451 is formed to connect the differential pressure regulator chamber 40*a* with the third fluid path 450. A communication hole 452 is formed to connect the third fluid path 450 with the fourth fluid path 460 provided inside the liquid feeder 50.

The upstream end of the chamber-to-chamber communicating path 380 (with the communication hole 381), the inlet 401, and the communication holes 412 and 442 are respectively formed on the respective bottom faces of the tank chamber 370, the end chamber 390, the bubble separation chamber 410, and the buffer chamber 440. This layout enables the respective communication holes and inlet to be located at the lower positions of the tank chamber 370, the end chamber 390, the bubble separation chamber 410, and the buffer chamber 440 in the vertical direction in attachment of the ink cartridge 1 to the carriage 200 with the respective bottom faces downward in the vertical direction. This arrangement effectively prevents the little remain of ink from being wastefully left in these spaces with the progress of ink consumption. This arrangement also makes bubbles move upward in the vertical direction and prevents migration of bubbles in the downstream.

Spaces 501 and 503 shown in FIGS. 11 and 13(*a*) function as non-fill chambers that are not filled with ink. The non-fill chambers 501 and 503 are not located on the pathway from the air hole 100 to the liquid feeder 50 but are isolated. The non-fill chambers 501 and 503 respectively have air communication holes 502 and 504 formed on the respective rear faces. The non-fill chambers 501 and 503 function as deaeration chambers with accumulated negative pressures in vacuum packaging of the ink cartridge 1. Namely in the packaged ink cartridge 1, the atmospheric pressure inside the cartridge body 10 is kept to or below a specified value to supply ink with little dissolved air.

Ink Flow and Air Flow in Ink Cartridge

In the ink cartridge 1 of the embodiment, the ink stored in the tank chamber 370 is introduced through the chamber-to-chamber communicating path 380 into the end chamber 390 and flows from the end chamber 390 to the bubble separation chamber 410 via the vertical communicating path 400. The ink flow reaching the bubble separation chamber 410 is introduced to the sensor unit 30 via the first fluid path 420 and is accumulated in the second fluid path 430 and the buffer chamber 440. Namely the buffer chamber 440 functions as a reservoir for storing the ink that is to be introduced to the differential pressure regulator 40 located in the downstream. With consumption of ink by the print head, the pressure in the liquid feeder 50 decreases to open the differential pressure regulator 40. The ink accordingly flows from the buffer chamber 440 through the communication hole 442 into the differential pressure regulator chamber 40*a*, further goes through the third fluid path 450 and the fourth fluid path 460, and is eventually supplied from the liquid feeder 50 to the print head. The differential pressure regulator 40 keeps the ink supply pressure to the print head in an adequate pressure range, thus ensuring stable ink ejection from the print head.

The air taken in from the air hole 100 is introduced through the serpentine path 310 into the gas liquid separation chamber 70*a*. The air introduced in the gas liquid separation chamber 70*a* flows through the air chambers 320 to 360 and enters the tank chamber 370.

Manufacturing Methods of Ink Supply System

Manufacturing methods of an ink supply system with the ink cartridge 1 discussed above are described below.

Manufacturing Method of Ink Supply System by First Connection Example

Figure 14A:
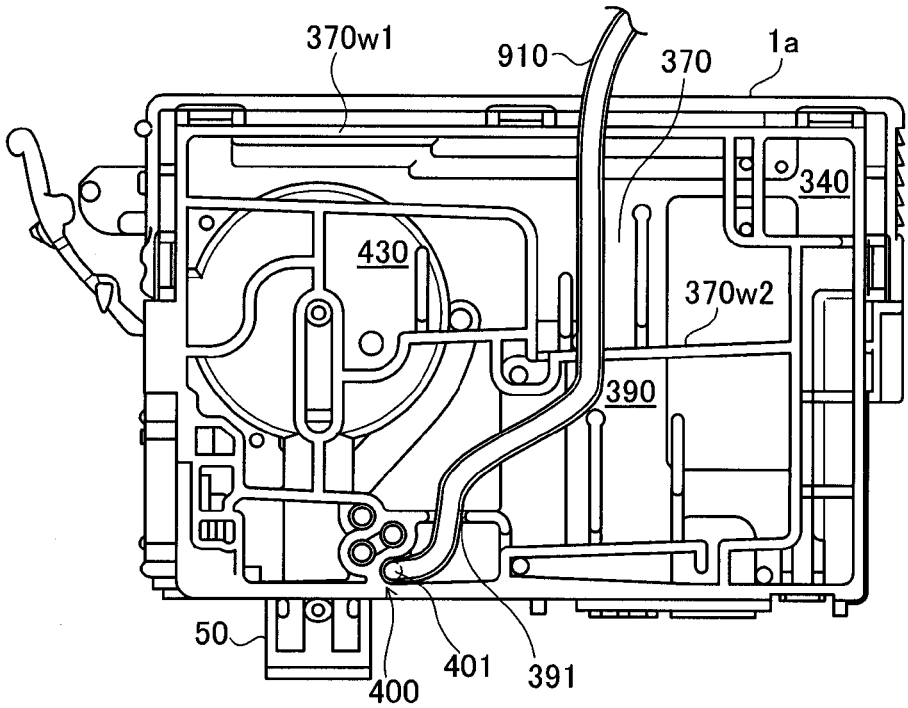
FIGS. 14(A) and 14(B) are explanatory views showing connection of the ink cartridge with an ink supply tube by a first connection example.
Figure 14B:
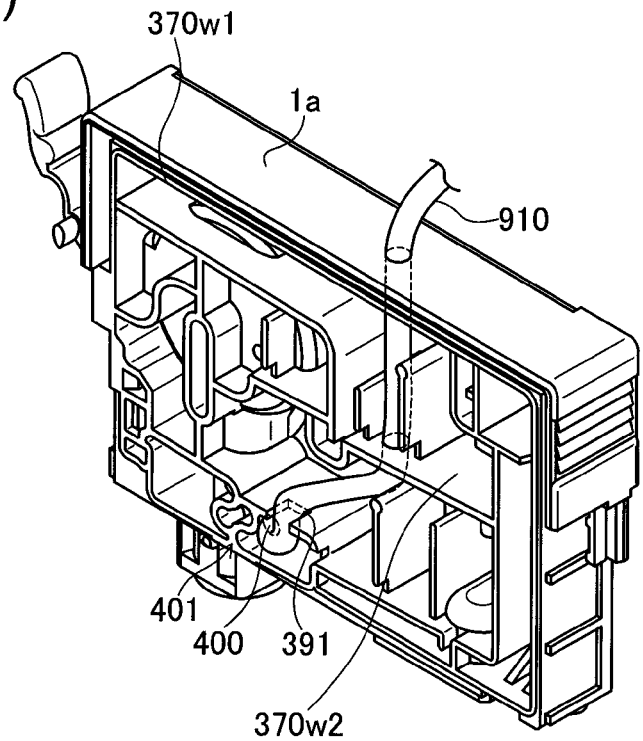
Figure 15:
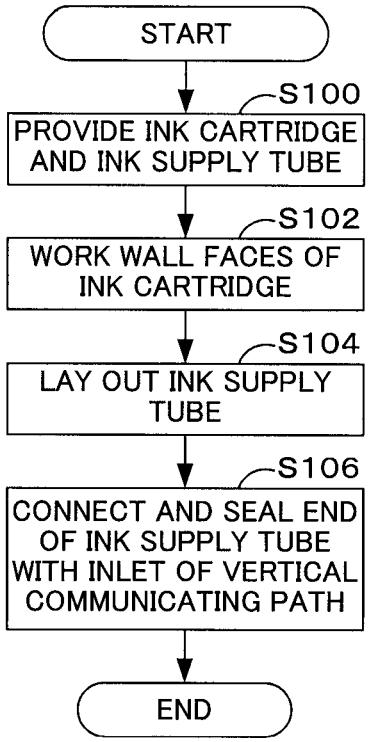
FIG. 15 is a flowchart showing a manufacturing method of an ink supply system by the first connection example.
Figure 16A:
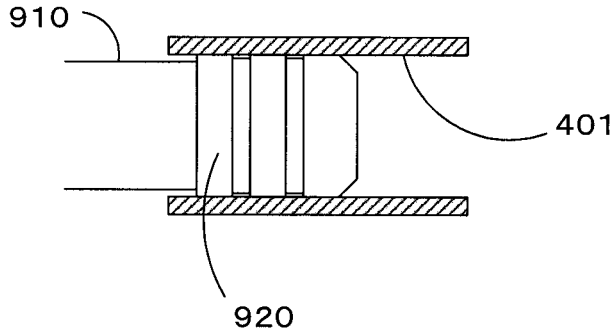
FIGS. 16(A) and 16(B) are explanatory views schematically showing a connection site of the ink supply tube and a vertical communicating path in the ink cartridge.
Figure 16B:
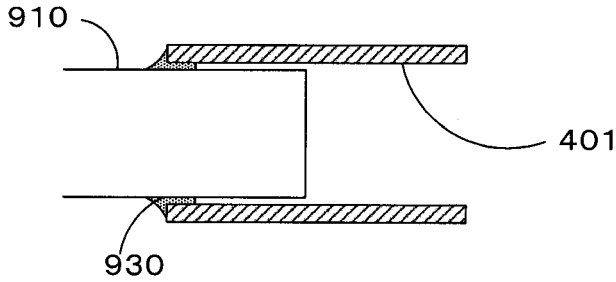
Figure 17:
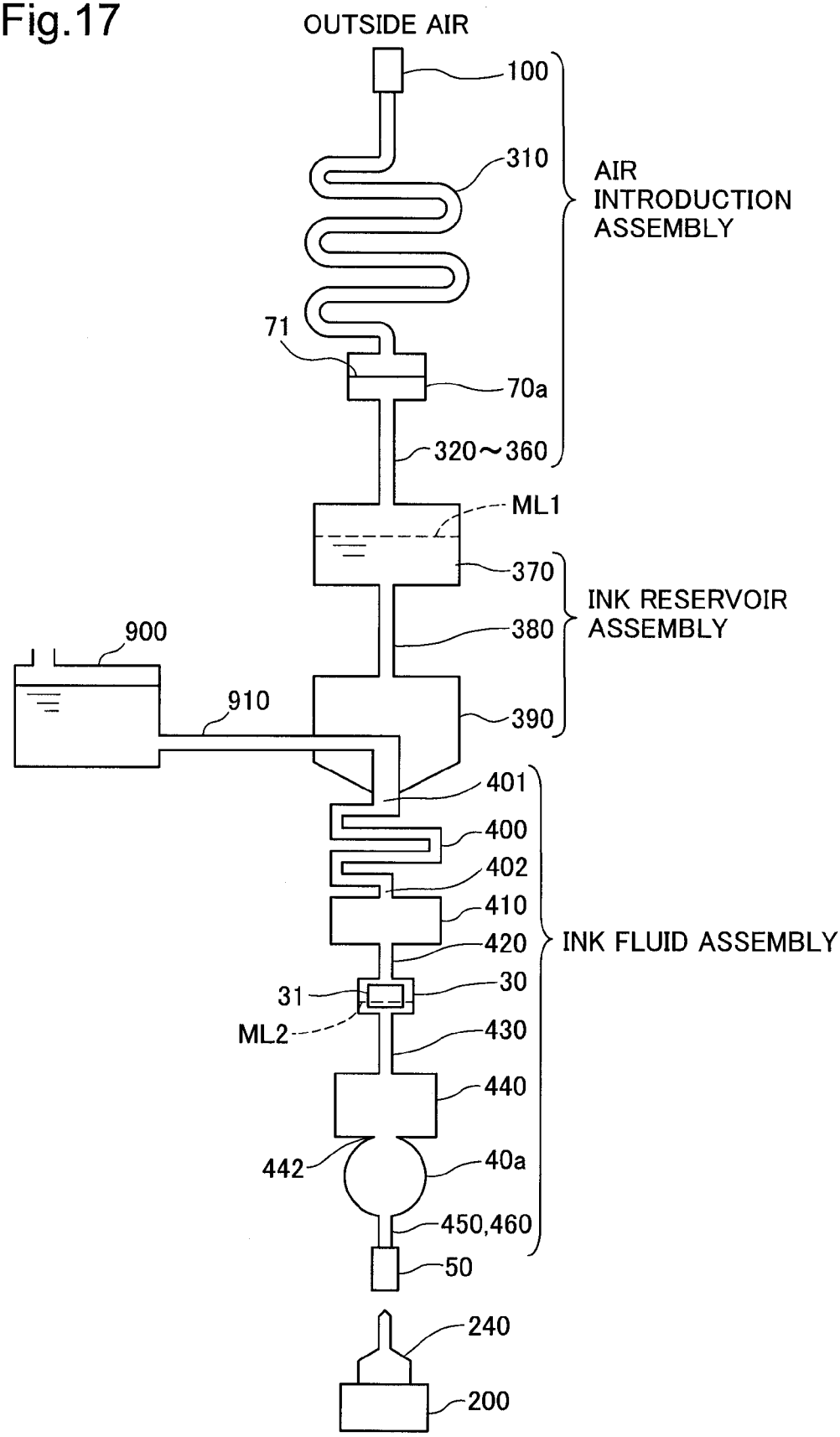
FIG. 17 is a conceptive view showing pathway of the ink supply system by the first connection example.

A first connection example of an ink cartridge with an ink supply tube is discussed below with reference to FIGS. 14 through 17. FIGS. 14(A) and 14(B) are explanatory views showing connection of the ink cartridge 1 with an ink supply tube 910 by the first connection example. FIG. 15 is a flowchart showing a manufacturing method of an ink supply system by the first connection example. FIG. 16 is explanatory views schematically showing a connection site of the ink supply tube 910 and the vertical communicating path 400 in the ink cartridge 1, with an attachment member in FIG. 16(A) and without any attachment member in FIG. 16(B). FIG. 17 is a conceptive view showing pathway of the ink supply system by the first connection example. In the first connection example, the ink supply tube 910 is inserted through the top face or top wall face 1*a* of the ink cartridge 1, an upper wall face 370*w*1 of the tank chamber 370, and a lower wall face 370*w*2 of the tank chamber 370 (wall face parting the tank chamber 370 from the end chamber 390) and is connected with the inlet 401 of the vertical communicating path 400 via a communication hole 391 formed inside the end chamber 390. A supply of ink from a large-capacity ink tank 900 (see FIGS. 17 and 26) is thus directly introduced into the vertical communicating path 400. The ink supply tube 910 is preferably made of a flexible material.

With referring to the flowchart of FIG. 15, the first connection example provides an ink cartridge, for example, the ink cartridge 1 of the embodiment discussed above, and the ink supply tube 910 (step S100). An attachment member is preferably mounted on a specific end of the ink supply tube 910, which is to be connected with the ink cartridge 1. The attachment member is, for example, a rubber or plastic ring member with an opening for insertion of the specific end of the ink supply tube 910. The plastic attachment member preferably has a seal member, such as an O-ring. Prior to connection with the ink supply tube 910, the ink cartridge 1 has the tank chamber 370 as the liquid reservoir, the end chamber 390, and the buffer chamber 430 sealed with the film 80. The casing member 20 is set on the outside of the film 80 (see FIG. 3). The first connection example removes the casing member 20, peels off part of the film 80 or the whole film 80, and works the wall faces 1*a*, 370*w*1, and 370*w*2 (step S102). A concrete technique of working the wall faces may pierce or cut out each wall face to form a hole or a cutout in the wall face. In the structure of the wall face 370*w*1 integrated with the wall face 1*a*, only the wall face 1*a* may be pierced or cut out to form a hole or a cutout. The first connection example directly connects the ink supply tube 910 with the inlet 401 of the vertical communicating path 400. As long as the ink supply is available from the ink cartridge 1 attached to the ink-jet printer, the sealing property in the upstream of the inlet 401 (on the atmospheric side) is of no great importance. The first connection example may thus peel off only part of the film 80 covering the tank chamber 370 or the whole film 80 covering a specific area in the upstream of the end chamber 390.

On completion of the working on the wall faces of the ink cartridge 1, the first connection example lays out and fixes the ink supply tube 910 (step S104). The ink supply tube 910 is fit in the holes or cutouts formed in the wall faces 1*a*, 370*w*1 and 370*w*2. The ink supply tube 910 is fixed by application of an adhesive at an insertion of the ink supply tube 910 in the wall face 370*w*1 of the tank chamber 370 or by application of a ring-shaped fixation member. The first connection example then connects and seals the end of the laid-out ink supply tube 910 with the inlet 401 of the vertical communicating path 400 (step S106). This series of operations completes connection of the ink supply tube 910 with the ink cartridge 1. In the structure with an attachment member 920 mounted on the specific end of the ink supply tube 910, insertion of the attachment member 920 into the inlet 401 accomplishes the connection and the sealing as shown in FIG. 16(A). In the structure without any attachment member mounted on the specific end of the ink supply tube 910, on the other hand, the specific end of the ink supply tube 910 is directly inserted into and connected with the inlet 401 as shown in FIG. 16(B). A clearance formed between the specific end of the tube 910 and the inlet 401 is sealed by application of an adhesive or a caulking agent 930. This series of operations produces the assembly of the ink cartridge 1 connected with the ink supply tube 910, which is used for the ink supply system of the embodiment. After the ink fill according to the requirements, the casing member 20 is set on the assembly of the ink cartridge 1 with the ink supply tube 910. Connection of the other end of the ink supply tube 910 with the large-capacity ink tank 900 completes the ink supply system. Attachment of the ink cartridge 1 connected with one end of the ink supply tube 910 to the ink-jet printer and subsequent connection of the large-capacity ink tank 900 to the other end of the ink supply tube 910 also complete the ink supply system. In the completed ink supply system, the ink cartridge 1 with the ink supply tube 910 connected to the vertical communicating path 400 is attached to the ink-jet printer.

The pathway of the ink supply system by the first connection example is described below with reference to FIG. 17. The large-capacity ink tank 900 is connected with the inlet 401 of the vertical communicating path 400 via the ink supply tube 910 to directly supply ink to the bubble separation chamber 410. The vertical communicating path 400 and the bubble separation chamber 410 are provided to control or prevent migration of bubbles into the sensor unit 30. Even when bubbles are incorporated in the ink supplied from the large-capacity ink tank 900, this structure effectively controls or prevents migration of bubbles into the sensor unit 30. The flow paths and the chambers in the downstream of the vertical communicating path 400 are filled with ink in the ordinary state. Compared with the ink supply via the tank chamber 370 and the end chamber 390, such direct ink supply effectively controls or prevents migration of bubbles, thus desirably decreasing or substantially eliminating the potential for false detection by the sensor unit 30.

The first connection method performs the ink supply in the upstream of the sensor unit 30. This arrangement effectively controls or prevents migration of bubbles into the sensor unit 30. In the structure of ink supply in the downstream of the sensor unit 30, the ink remaining state in the sensor unit 30 is not accurately controllable. The sensor unit 30 has no ink flow. The air (bubbles) enters the sensor unit 30 with elapse of time by expansion of the air in the changing environment or by gas permeation of a specific gas transmittable through the plastic material. Such migration of bubbles may cause the sensor unit 30 to falsely detect an insufficient level of remaining ink or out-of-ink in the ink cartridge 1. Even when the large-capacity ink tank 900 still has a sufficient level of remaining ink, the ink-jet printer stops printing based on the result of the false detection of an insufficient ink level or out-of-ink. In the ink supply system of the embodiment, on the other hand, ink is supplied in the upstream of the sensor unit 30. The ink supply from the large-capacity ink tank 900 is thus introduced through the liquid feeder 50 to the ink-jet printer via the sensor unit 30. This arrangement allows arbitrary control of the ink level (ink filling) in the sensor unit 30 and is free from the potential problems, which arise in the structure of ink supply in the downstream of the sensor unit 30. In the ink supply system of the embodiment, the ink is supplied in the upstream of the vertical communicating path 400 and the bubble separation chamber 410. Even when the supplied ink contains bubbles, this arrangement effectively controls or prevents migration of bubbles into the sensor unit 30. The direct supply of ink to the vertical communicating path 400 arranged close to the sensor unit 30 does not require the ink supply (ink filling) to the tank chamber 370 as the liquid reservoir or the end chamber 390, thus desirably decreasing the initial injection amount of ink to be filled after connection of the ink supply tube 910 with the ink cartridge 1. This arrangement desirably shortens the total time required for initial ink injection. The first connection example directly connects the ink supply tube 910 with the vertical communicating path 400 formed as a chamber-to-chamber communicating path. This arrangement does not require sealing of an upstream communicating path in the upstream of the vertical communicating path 400 arranged to connect an upstream chamber, which communicates with the vertical communicating path 400 connected to the ink supply tube 910, with a further upstream chamber, thus desirably saving the time required for such sealing.

As described above, the first connection example connects the ink supply tube 910 with the inlet 401 of the vertical communicating path 400 located in the upstream of the sensor unit 30. This arrangement ensures the stable supply of a large mass of ink, while effectively decreasing or substantially eliminating the potential for false detection of the ink level remaining in the ink cartridge 1 by the sensor unit 30. The stable supply of the large mass of ink satisfies a mass print requirement without replacement of ink cartridges, thus enhancing the user's convenience.

Figure 18A:
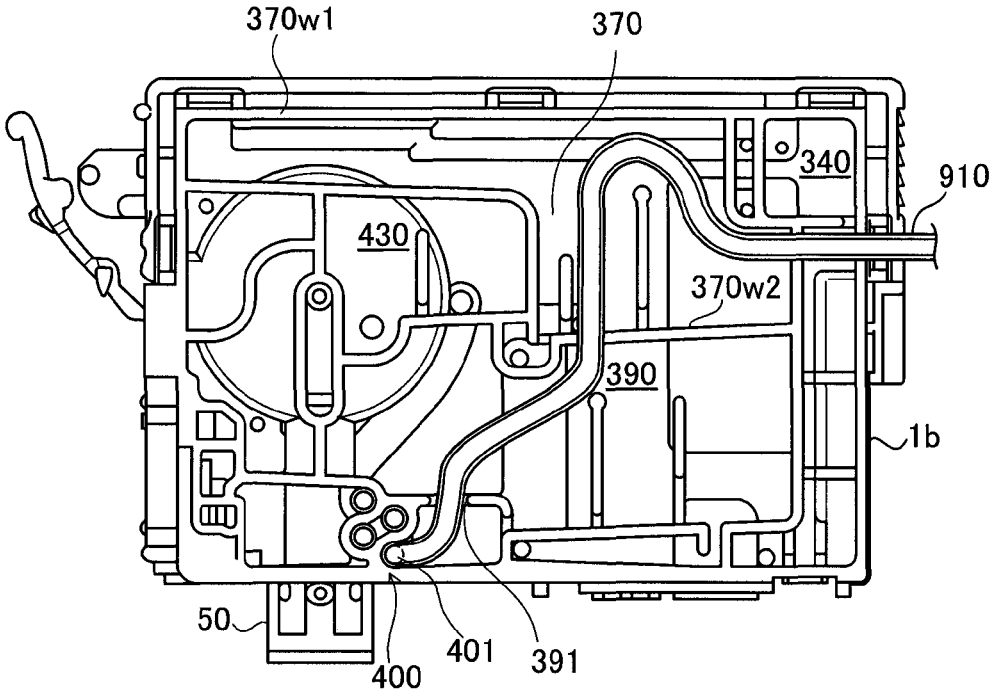
FIGS. 18(A) and 18(B) show other connecting positions of the ink supply tube with the ink cartridge.
Figure 18B:
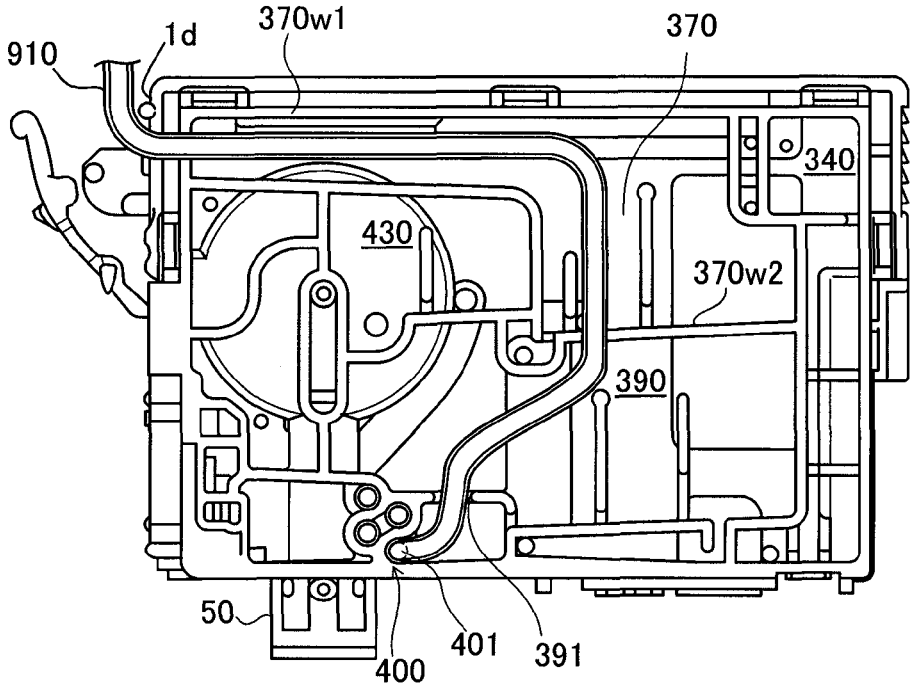
Figure 19:
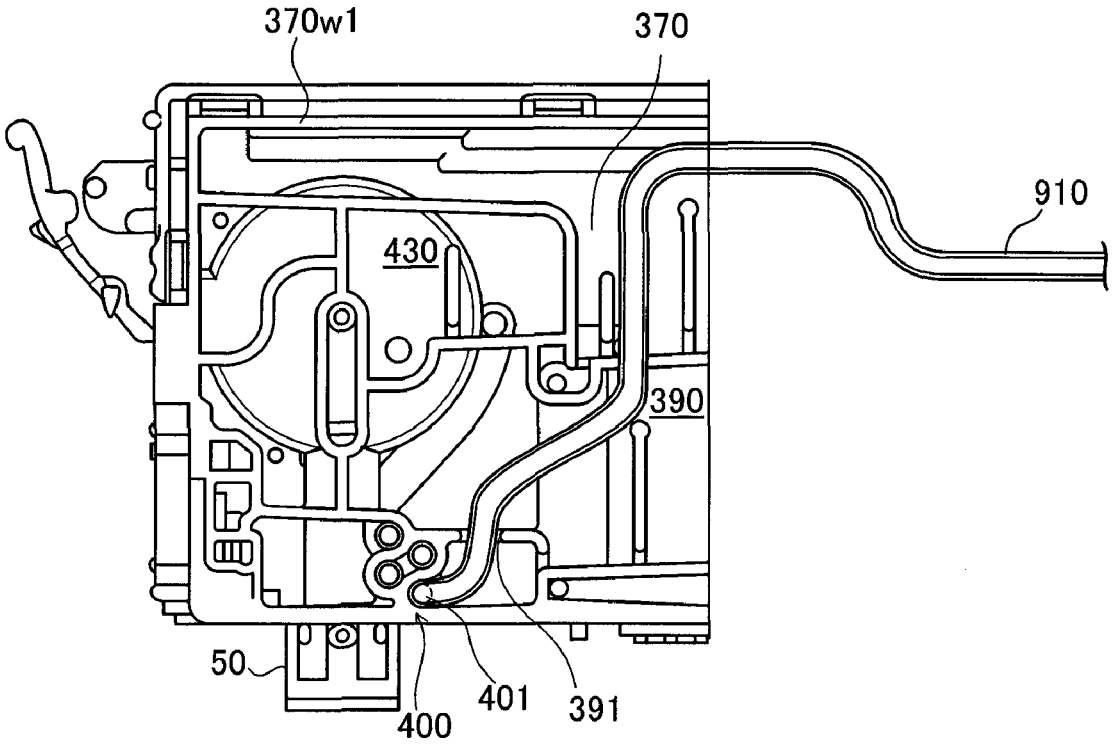
FIG. 19 shows another example of working the ink cartridge.

FIGS. 18(A) and 18(B) show other connecting positions of the ink supply tube 910 with the ink cartridge 1. FIG. 19 shows another example of working the ink cartridge 1. The first connection example discussed above inserts the ink supply tube 910 through the top wall face 1*a* of the ink cartridge 1 to be connected with the ink cartridge 1. The ink supply tube 910 may be inserted through the right wall face 1*c* or through the left wall face 1*d* of the ink cartridge 1 to be connected with the ink cartridge 1 as shown in FIGS. 18(A) and 18(B). In another structure, a specific part of the ink cartridge 1 may be cut off as shown in FIG. 19. This modified structure does not require advanced working of the ink cartridge 1 to form holes or cutouts in the relevant wall faces of the ink cartridge 1 but completes an ink supply system by simple connection of a specific end of the ink supply tube 910 with the inlet 401 of the vertical communicating path 400, while facilitating the layout of the ink supply tube 910. The ink cartridge 1 is attached to and fixed to the carriage 200 by the catch lever 11. The ink cartridge 1 with omission of the specific part is still attachable and fixable to the ink-jet printer by means of the catch lever 11. The cutoff structure of FIG. 19 is only illustrative and not restrictive in any sense. The cutting surface may be not linear but may be curved. A part of any arbitrary shape may be cut off from the ink cartridge 1 as long as smooth and adequate in supply is assured. Any of such modifications does not affect the direct supply of ink to the vertical communicating path 400 via the ink supply tube 910 and thus exerts the same functions and effects as those of the first connection example discussed above.

Manufacturing Method of Ink Supply System by Second Connection Example

Figure 20A:
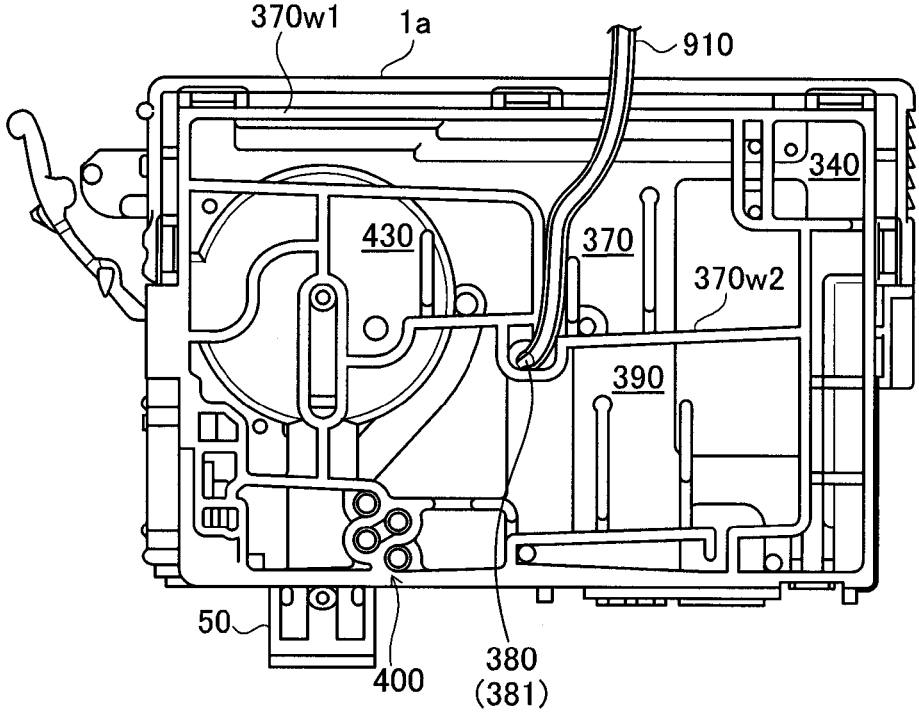
FIGS. 20(A) and 20(B) are explanatory views showing connection of the ink cartridge with the ink supply tube by a second connection example.
Figure 20B:
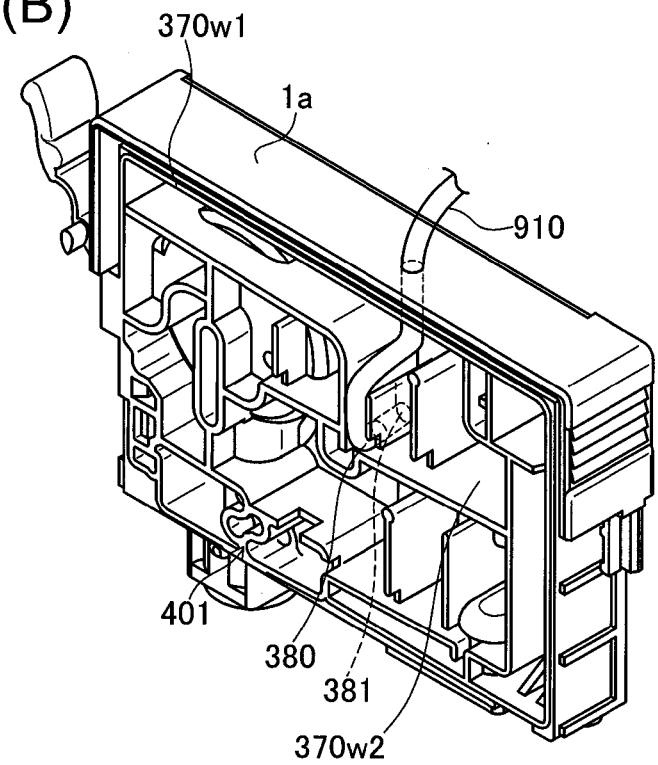
Figure 21:
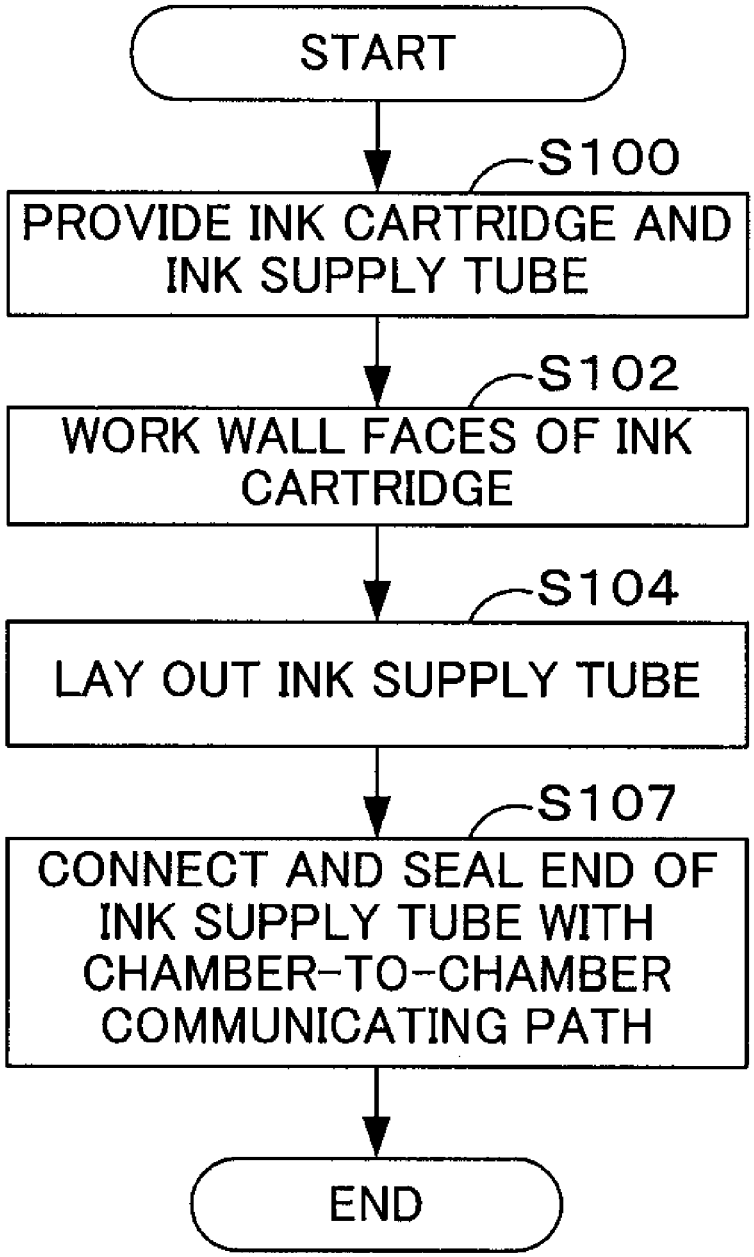
FIG. 21 is a flowchart showing a manufacturing method of an ink supply system by the second connection example.
Figure 22:
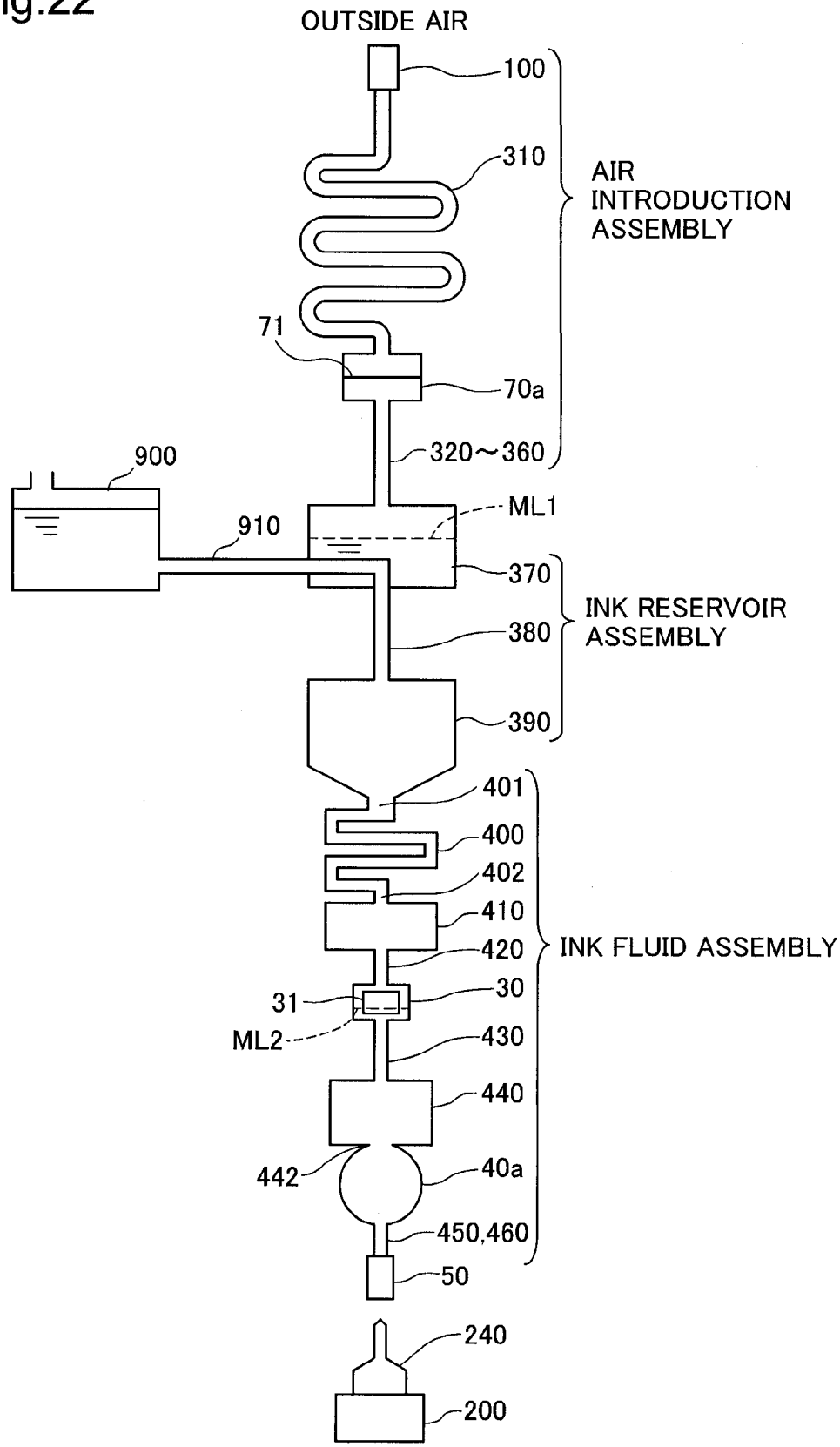
FIG. 22 is a conceptive view showing pathway of the ink supply system by the second connection example.

A second connection example of an ink cartridge with an ink supply tube is discussed below with reference to FIGS. 20 through 22. FIGS. 20(A) and 20(B) are explanatory views showing connection of the ink cartridge 1 with the ink supply tube 910 by the second connection example. FIG. 21 is a flowchart showing a manufacturing method of an ink supply system by the second connection example. FIG. 22 is a conceptive view showing pathway of the ink supply system by the second connection example. In the second connection example, the ink supply tube 910 is inserted through the top face or top wall face 1*a* of the ink cartridge 1 and the upper wall face 370*w*1 of the tank chamber 370 and is connected with the chamber-to-chamber communicating path 380 via a communication hole 371 formed inside the tank chamber 370. A supply of ink from the large-capacity ink tank 900 (see FIGS. 22 and 26) is thus directly introduced into the chamber-to-chamber communicating path 380.

The second connection example is discussed below in detail. The like steps in the second connection example to those in the first connection example are shown by the like step numbers and are not specifically explained here. The second connection example provides the ink cartridge 1 and the ink supply tube 910 (step S100), and removes the casing member 20, peels off part of the film 80 or the whole film 80, and works the wall faces 1*a* and 370*w*1 (step S102). A concrete technique of working the wall faces may pierce or cut out each wall face to form a hole or a cutout in the wall face. The second connection example directly connects the ink supply tube 910 with the chamber-to-chamber communicating path 380. As long as the ink supply is available from the ink cartridge 1 attached to the ink-jet printer, the sealing property in the upstream of the chamber-to-chamber communicating path 380 (on the atmospheric side) is of no great importance. The second connection example may thus peel off only part of the film 80 covering the tank chamber 370 or the whole film 80 covering a specific area in the upstream of the tank chamber 370.

On completion of the working on the wall faces of the ink cartridge 1, the second connection example lays out and fixes the ink supply tube 910 (step S104). The ink supply tube 910 is fixed and is fit in the holes or cutouts formed in the wall faces 1*a* and 370*w*1. The second connection example then connects and seals the end of the laid-out ink supply tube 910 with the chamber-to-chamber communicating path 380 (step S107). This series of operations completes connection of the ink supply tube 910 with the ink cartridge 1. In the structure with an attachment member mounted on the specific end of the ink supply tube 910, insertion of the attachment member into the inlet of the chamber-to-chamber communicating path 380 (communication hole 381) accomplishes the connection and the sealing. In the structure without any attachment member mounted on the specific end of the ink supply tube 910, on the other hand, the specific end of the ink supply tube 910 is directly inserted into and connected with the communication hole 381. A clearance formed between the specific end of the tube 910 and the communication hole 381 is sealed by application of an adhesive or a caulking agent. After the ink fill according to the requirements, the casing member 20 is set on the assembly of the ink cartridge 1 with the ink supply tube 910. Connection of the other end of the ink supply tube 910 with the large-capacity ink tank 900 completes the ink supply system.

The pathway of the ink supply system by the second connection example is described below with reference to FIG. 22. The large-capacity ink tank 900 is connected with the chamber-to-chamber communicating path 380 via the ink supply tube 910 to directly supply ink to the end chamber 390. The supply of ink is then introduced into the bubble separation chamber 410 via the end chamber 390 and the vertical communicating path 400. The vertical communicating path 400 and the bubble separation chamber 410 are provided to control or prevent migration of bubbles into the sensor unit 30. Even when bubbles are incorporated in the ink supplied from the large-capacity ink tank 900, this structure effectively controls or prevents migration of bubbles into the sensor unit 30. The direct supply of ink to the chamber-to-chamber communicating path 380 causes the end chamber 390 to be filled with ink and decreases the potential for the air migration. This arrangement effectively reduces or removes the bubbles, which may be incorporated in the ink, thus desirably decreasing or substantially eliminating the potential for false detection by the sensor unit 30.

The second connection method also performs the ink supply in the upstream of the sensor unit 30. This arrangement effectively controls or prevents migration of bubbles into the sensor unit 30. In the structure of ink supply in the downstream of the sensor unit 30, the ink remaining state in the sensor unit 30 is not accurately controllable. The air (bubbles) enters the sensor unit 30 with elapse of time. Such migration of bubbles may cause the sensor unit 30 to falsely detect an insufficient level of remaining ink or out-of-ink in the ink cartridge 1. Even when the large-capacity ink tank 900 still has a sufficient level of remaining ink, the ink-jet printer stops printing based on the result of the false detection of an insufficient ink level or out-of-ink. In the ink supply system of the embodiment, on the other hand, ink is supplied in the upstream of the sensor unit 30. The ink supply from the large-capacity ink tank 900 is thus introduced through the liquid feeder 50 to the ink-jet printer via the sensor unit 30. This arrangement allows arbitrary control of the ink level (ink filling) in the sensor unit 30 and is free from the potential problems, which arise in the structure of ink supply in the downstream of the sensor unit 30. In the ink supply system of the embodiment, the ink is supplied in the upstream of the vertical communicating path 400 and the bubble separation chamber 410. Even when the supplied ink contains bubbles, this arrangement effectively controls or prevents migration of bubbles into the sensor unit 30.

As described above, the second connection example connects the ink supply tube 910 with the chamber-to-chamber communicating path 380 located in the upstream of the sensor unit 30. This arrangement ensures the stable supply of a large mass of ink, while effectively decreasing or substantially eliminating the potential for false detection of the ink level remaining in the ink cartridge 1 by the sensor unit 30. The stable supply of the large mass of ink satisfies a mass print requirement without replacement of ink cartridges, thus enhancing the user's convenience.

The second connection example discussed above inserts the ink supply tube 910 through the top wall face 1*a* of the ink cartridge 1 to be connected with the ink cartridge 1. As in the first connection example, the ink supply tube 910 may be inserted through the right wall face 1*c* or through the left wall face 1*d* of the ink cartridge 1 to be connected with the ink cartridge 1. In another structure, a specific part of the ink cartridge 1 may be cut off. Any of such modifications does not affect the direct supply of ink to the chamber-to-chamber communicating path 380 via the ink supply tube 910 and thus exerts the same functions and effects as those of the second connection example discussed above.

Manufacturing Method of Ink Supply System by Third Connection Example

Figure 23A:
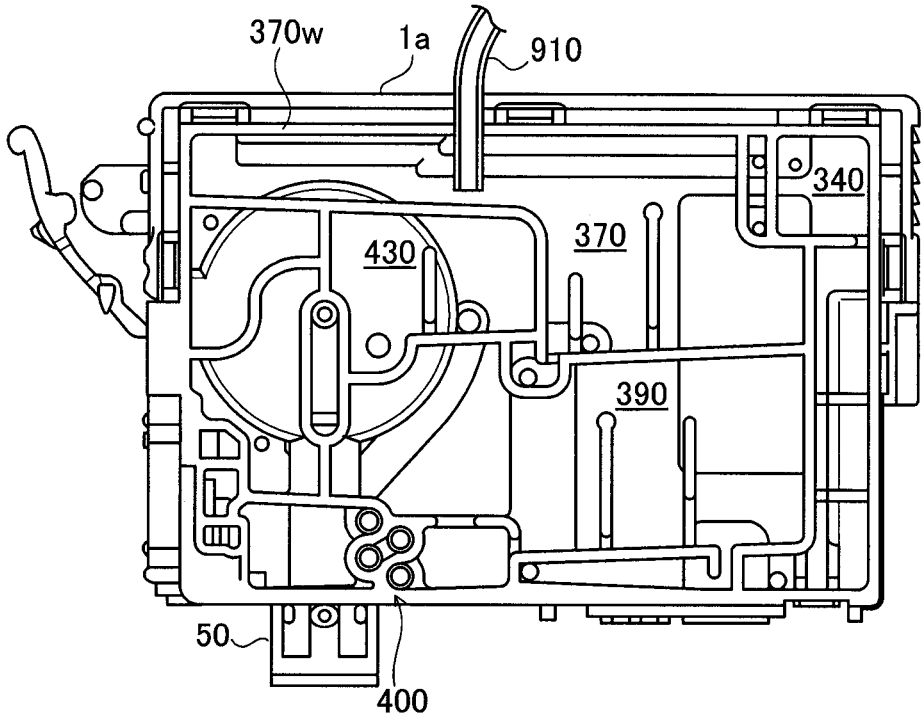
FIGS. 23(A) and 23(B) are explanatory views showing connection of the ink cartridge with the ink supply tube by a third connection example.
Figure 23B:
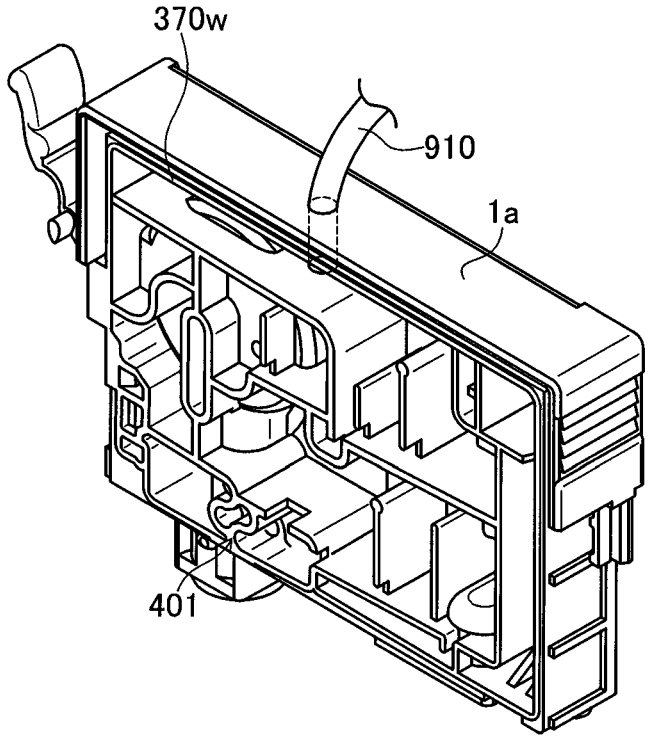
Figure 24:
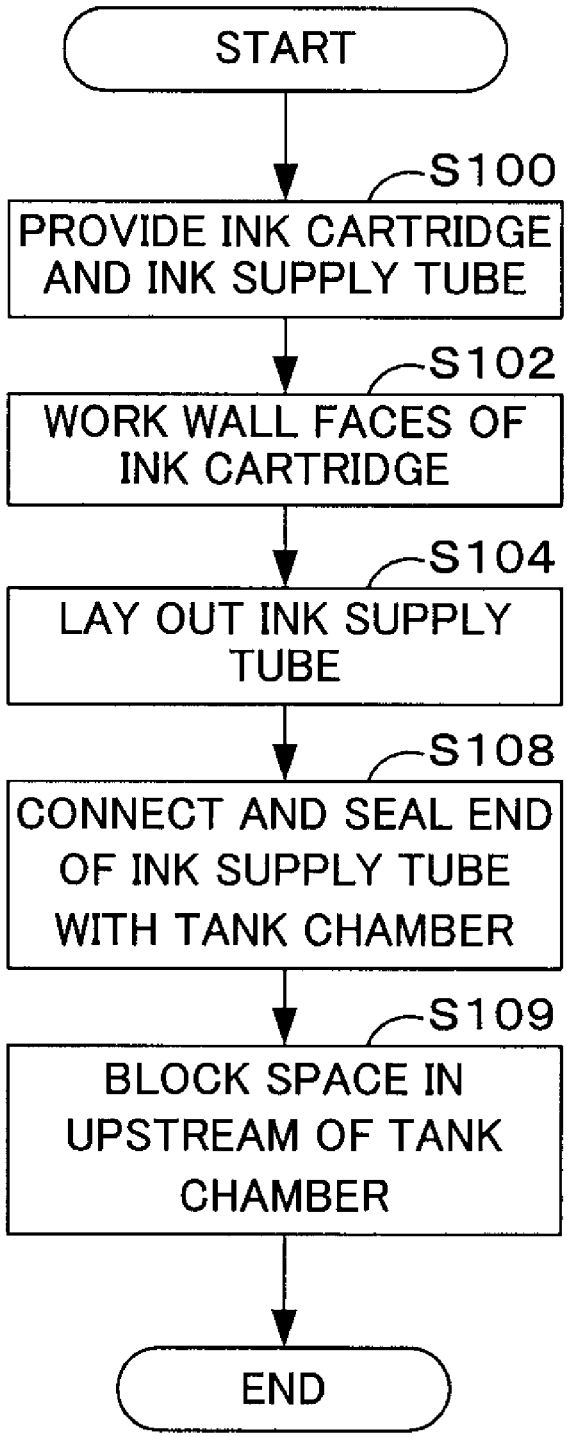
FIG. 24 is a flowchart showing a manufacturing method of an ink supply system by the third connection example.
Figure 25:
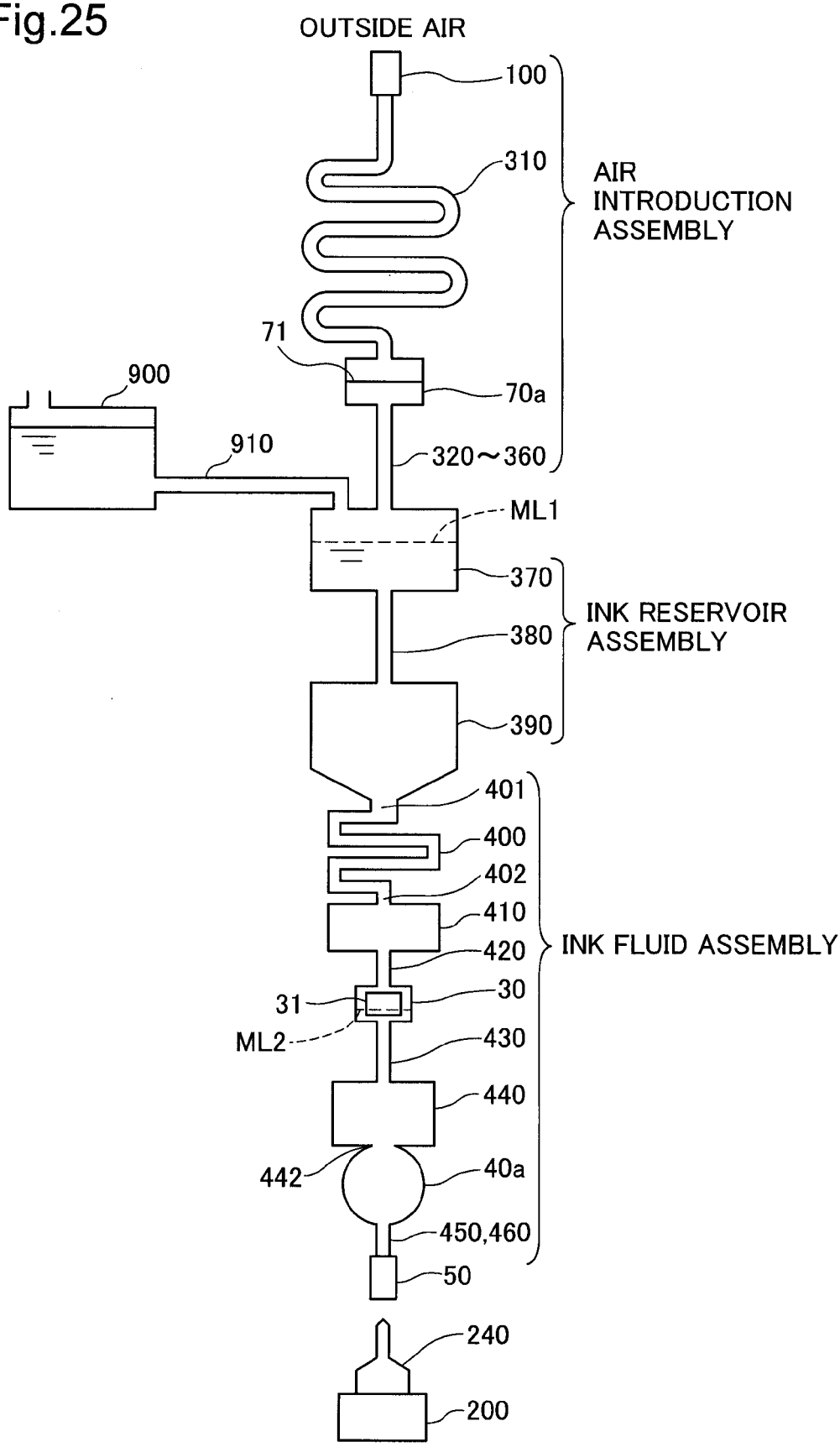
FIG. 25 is a conceptive view showing pathway of the ink supply system by the third connection example.

A third connection example of an ink cartridge with an ink supply tube is discussed below with reference to FIGS. 23 through 25. FIGS. 23(A) and 23(B) are explanatory views showing connection of the ink cartridge 1 with the ink supply tube 910 by the third connection example. FIG. 24 is a flowchart showing a manufacturing method of an ink supply system by the third connection example. FIG. 25 is a conceptive view showing pathway of the ink supply system by the third connection example. In the third connection example, the ink supply tube 910 is inserted through the top face or top wall face 1*a* of the ink cartridge 1 and the upper wall face 370*w*1 of the tank chamber 370 and is connected with the tank chamber 370. A supply of ink from the large-capacity ink tank 900 (see FIGS. 25 and 26) is thus directly introduced into the tank chamber 370.

The third connection example is discussed below in detail. The like steps in the third connection example to those in the first connection example are shown by the like step numbers and are not specifically explained here. The third connection example provides the ink cartridge 1 and the ink supply tube 910 (step S100), and removes the casing member 20, peels off part of the film 80 or the whole film 80, and works the wall faces 1*a* and 370*w*1 (step S102). It is not essential to peel off the film 80 in the third connection example of connecting the ink supply tube 910 at the position shown in FIG. 23. The third connection example pierces the wall faces 1*a* and 370*w*1 to form holes in the respective wall faces 1*a* and 370*w*1.

On completion of the working on the wall faces of the ink cartridge 1, the third connection example lays out the ink supply tube 910 (step S104). The ink supply tube 910 is fit in the holes formed in the wall faces 1*a* and 370*w*1. The third connection example subsequently fixes the end of the ink supply tube 910 to the holes formed in the wall faces 1*a* and 370*w*1 (step S108). A concrete technique of the fixation applies an adhesive or a caulking agent on a specific area about the end of the ink supply tube 910 fit in the holes formed in the wall faces 1*a* and 370*w*1. In the structure with an attachment member mounted on the specific end of the ink supply tube 910, the fixation of the ink supply tube 910 to the holes formed in the wall faces 1*a* and 370*w*1 is completed simultaneously with the layout of the ink supply tube 910.

The third connection example then blocks the flow path and the space in the upstream of the tank chamber 370 (step S109). Such blockage cuts off the connection of the tank chamber 370 with the upstream flow path and space. A concrete technique of the blockage injects a filler into the communication hole 372 formed in the wall face parting the tank chamber 370 from the fifth air chamber 360 (or into the communicating path connecting the tank chamber 370 with the fifth air chamber 360). The filler may be injected across the film 80 with an adequate tool, for example, a syringe. Another concrete technique of the blockage uses any of an adhesive, a sealing rubber, and a sealing film for the blockage of the communication hole 372 after peel-off of the film 80. The blockage of the communication hole 372 aims to prohibit an excess amount of the air taken in from the air hole 100 from entering the tank chamber 370. This restrains the occurrence of bubbles and thereby controls or prevents migration of bubbles into the sensor unit 30, so as to decrease or substantially eliminate the potential for the bubble-induced false detection of the sensor unit 30. On completion of the blockage, after the ink fill according to the requirements, the casing member 20 is set on the assembly of the ink cartridge 1 with the ink supply tube 910. Connection of the other end of the ink supply tube 910 with the large-capacity ink tank 900 completes the ink supply system.

The pathway of the ink supply system by the third connection example is described below with reference to FIG. 25. The large-capacity ink tank 900 is connected with the tank chamber 370 via the ink supply tube 910. The supply of ink is accordingly introduced into the bubble separation chamber 410 via the tank chamber 370, the end chamber 390, and the vertical communicating path 400. The vertical communicating path 400 and the bubble separation chamber 410 are provided to control or prevent migration of bubbles into the sensor unit 30. Even when bubbles are incorporated in the ink supplied from the large-capacity ink tank 900, this structure effectively controls or prevents migration of bubbles into the sensor unit 30.

The third connection method also performs the ink supply in the upstream of the sensor unit 30. This arrangement effectively controls or prevents migration of bubbles into the sensor unit 30 and thereby decreases or substantially eliminates the potential for false detection of a sufficient ink level or the out-of-ink due to migration of bubbles.

As described above, the third connection example connects the ink supply tube 910 with the tank chamber 370 located in the upstream of the sensor unit 30. This arrangement ensures the stable supply of a large mass of ink, while effectively decreasing or substantially eliminating the potential for false detection of the ink level remaining in the ink cartridge 1 by the sensor unit 30. The stable supply of the large mass of ink satisfies a mass print requirement without replacement of ink cartridges, thus enhancing the user's convenience. The third connection method supplies the ink not to the communicating path of connecting two chambers but directly to the chamber. In the structure of the ink cartridge with the ink reservoir assembly (tank chamber 370) located in the uppermost portion, the top face of the ink cartridge is pierced to form a hole. This desirably facilitates the working of the ink cartridge.

The third connection example discussed above inserts the ink supply tube 910 through the top wall face 1*a* of the ink cartridge 1 to be connected with the ink cartridge 1. As in the first connection example, the ink supply tube 910 may be inserted through the right wall face 1*c* or through the left wall face 1*d* of the ink cartridge 1 to be connected with the ink cartridge 1. In another structure, a specific part of the ink cartridge 1, for example, a site including the fourth air chamber 350, may be cut off.

Configuration Examples of Ink Supply System

Figure 26A:
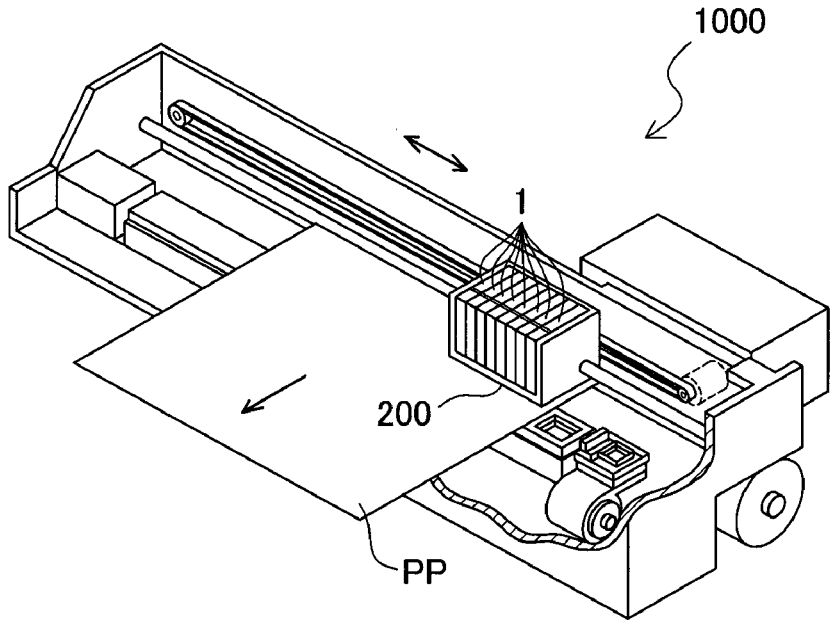
FIGS. 26(A) and 26(B) are perspective views showing the structures of an on-carriage type ink-jet printer and an ink supply system.

FIG. 26(A) is a perspective view showing the structure of an ink-jet printer 1000 as one example. The ink-jet printer 1000 has a carriage 200 designed to move in the main scanning direction and a feeder mechanism constructed to feed a sheet of print paper PP in a sub-scanning direction. A print head (not shown) is provided at a lower end of the carriage 200 and is used for printing on the print paper PP. The carriage 200 has a cartridge holder, on which multiple ink cartridges 1 having the structure discussed above are mounted and carried. The printer with the ink cartridges mounted on the carriage is called 'on-carriage type printer'.

Figure 26B:
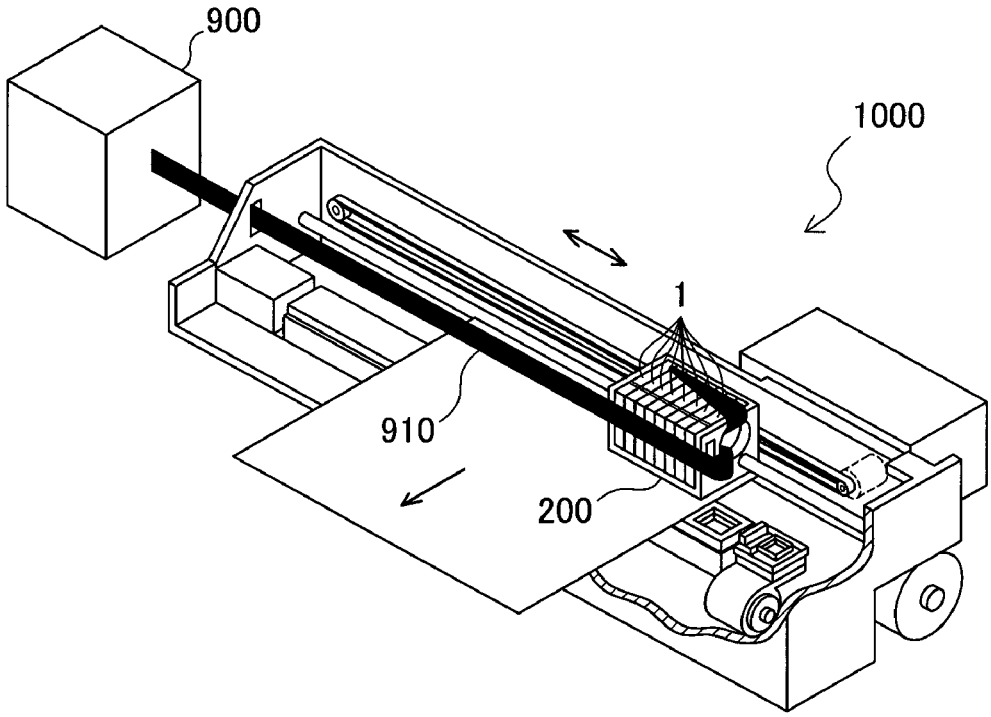

FIG. 26(B) is a perspective view showing the structure of an ink supply system with the ink-jet printer 1000. In this ink supply system, a large-capacity ink tank 900 is provided outside the ink-jet printer 1000. The large-capacity ink tank 900 is connected with the multiple ink cartridges 1 by an ink supply tube 910 as explained previously. The large-capacity ink tank 900 includes the same number of ink containers as the number of the multiple ink cartridges 1. The extension of the large-capacity ink tank 900 practically leads to a significant increase of the ink storage amount in the ink-jet printer 1000. The large-capacity ink tank 900 is also called 'external ink tank'.

Figure 27A:
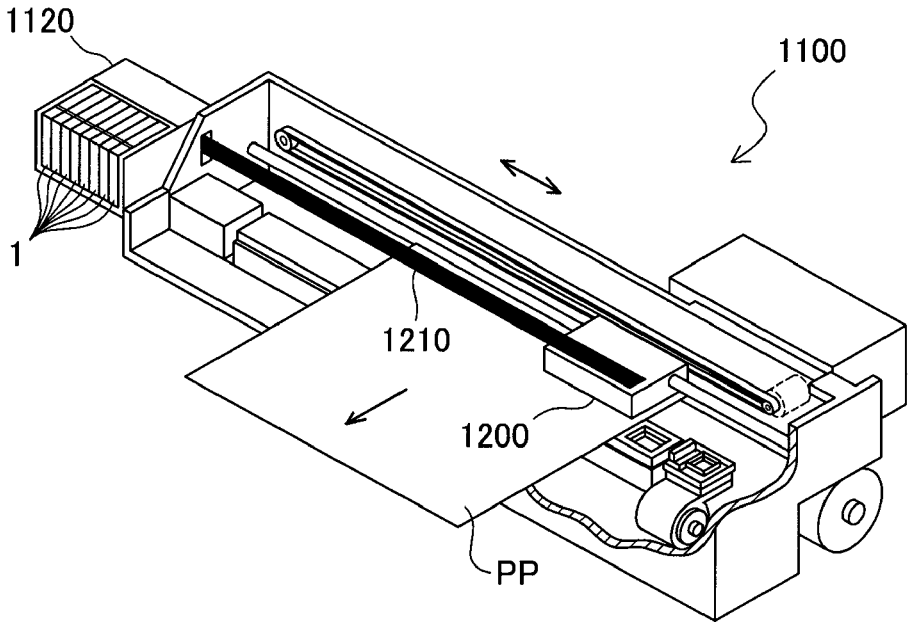
FIGS. 27(A) and 27(B) are perspective views showing the structures of an off-carriage type ink-jet printer and an ink supply system.

FIG. 27(A) is a perspective view showing the structure of an ink-jet printer 1100 as another example. In this ink-jet printer 1100, no ink cartridges are mounted on a carriage 1200, but a cartridge holder 1120 is provided outside the printer main body (outside the movable range of the carriage 1200). The multiple ink cartridges 1 are connected with the carriage 1200 by means of an ink supply tube 1210. The printer with the ink cartridges mounted on the different site other than the carriage is called 'off-carriage type printer'.

Figure 27B:
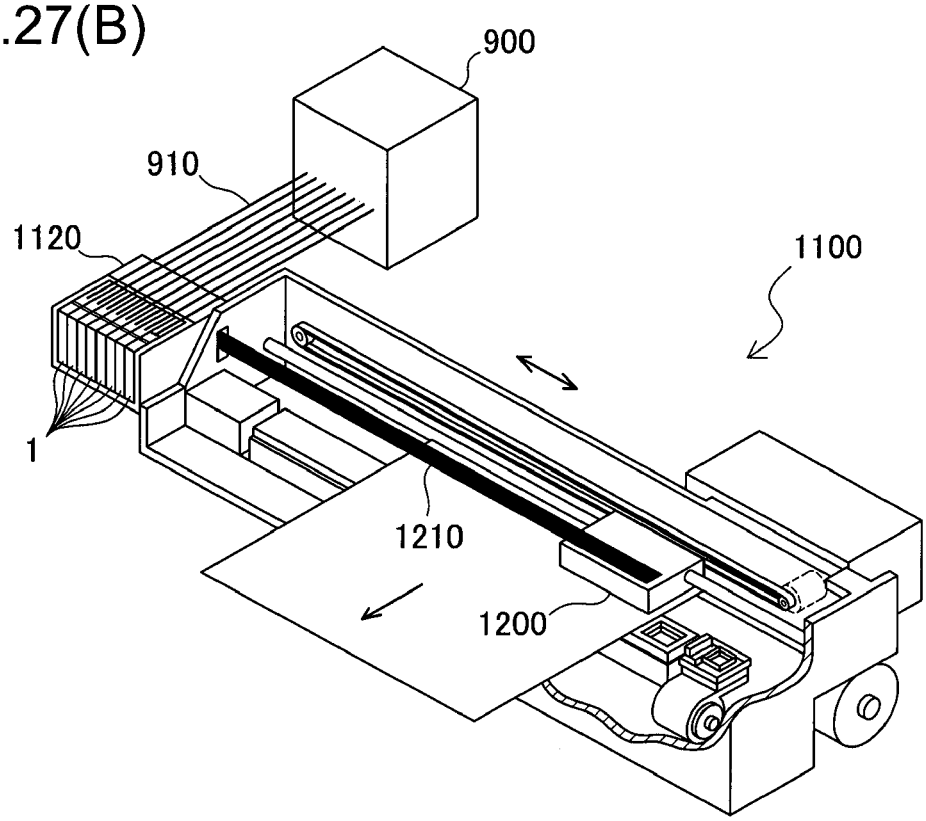

FIG. 27(B) is a perspective view showing the structure of an ink supply system with the ink-jet printer 1100. In this ink supply system, a large-capacity ink tank 900 is provided and is connected with the multiple ink cartridges 1 by an ink supply tube 910 as explained previously. Like the on-carriage type printer discussed above, the extension of the large-capacity ink tank 900 with the off-carriage type printer constructs the ink supply system having a significant increase of the ink storage amount.

In the specification hereof, the system assembly including one or multiple ink cartridges 1, the large-capacity ink tank 900, and the ink supply tube 910 is referred to as 'ink supply system'. The combination of this system assembly with an ink-jet printer may also be referred to as 'ink supply system'.

The ink cartridge 1 of the embodiment is applicable to both the on-carriage type ink-jet printer and the off-carriage type ink-jet printer.

Other Aspects (1) In the ink supply system of the embodiment, ink is supplied from the large-capacity ink tank 900 used for storage of the ink through the ink supply tube 910 to the ink cartridge 1. An ink supply pump may be attached to the other end of the ink supply tube 910. In this modified structure, the forcible ink supply to the ink cartridge 1 by means of the ink supply pump does not restrict the relative location of the large-capacity ink tank 900 to the ink-jet printer in the vertical direction. A preferable application controls the ink supply pump to supply ink of an adequate amount required for each printing operation to the ink cartridge 1.

Figure 28:
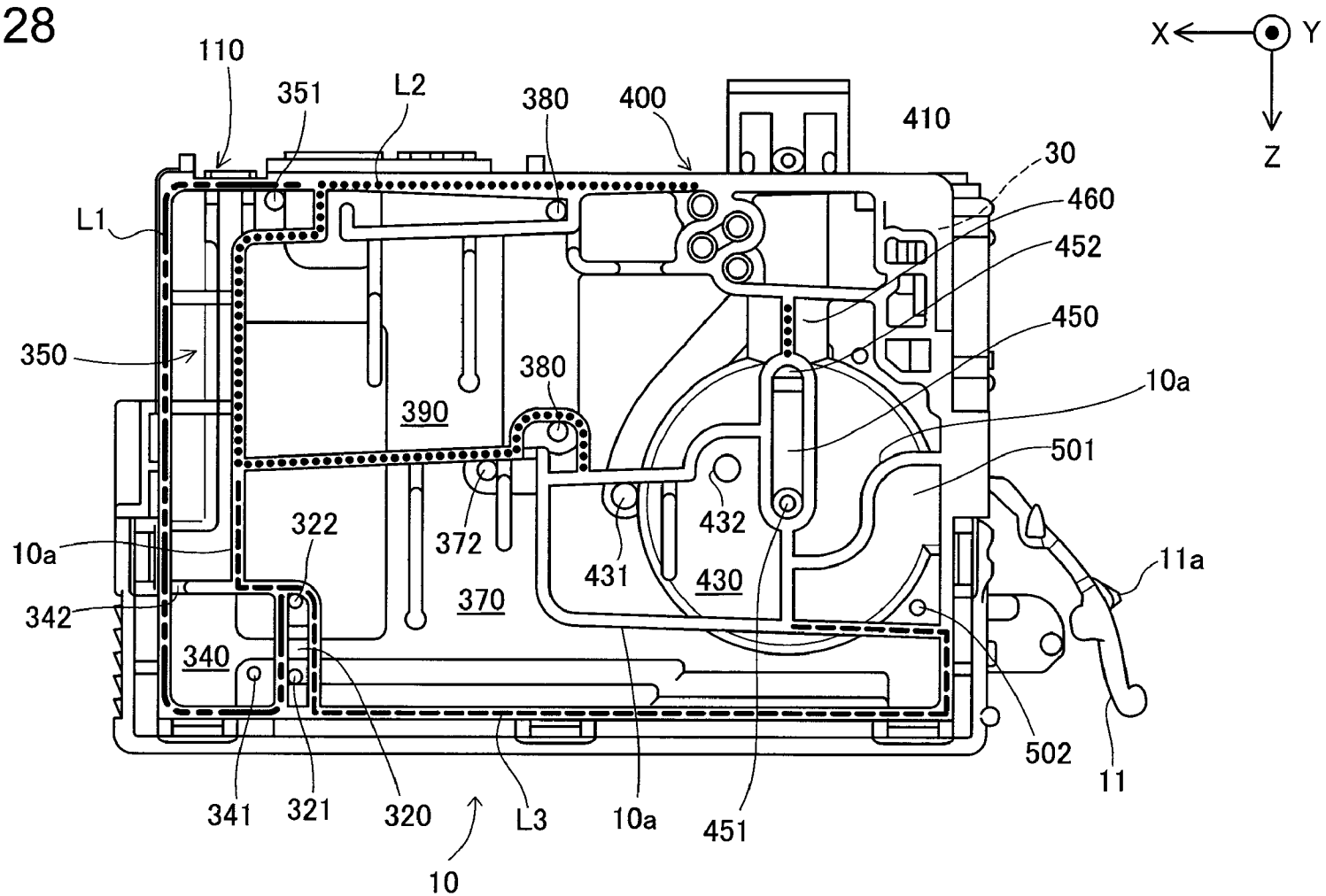
FIG. 28 is an explanatory view showing the internal structure of an ink cartridge in a first application of a modified example.
Figure 29:
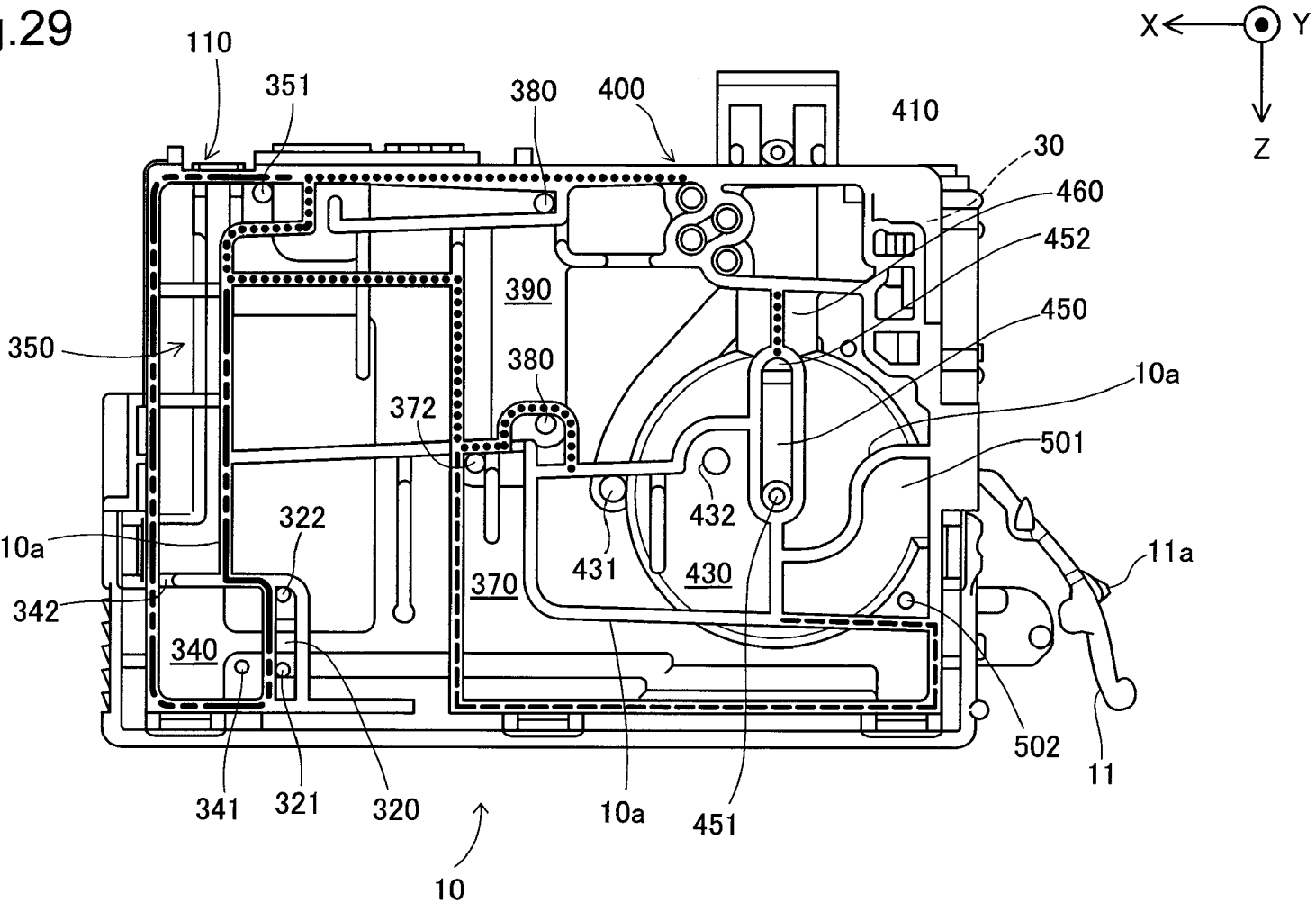
FIG. 29 is an explanatory view showing the internal structure of an ink cartridge in a second application of the modified example.
Figure 30:
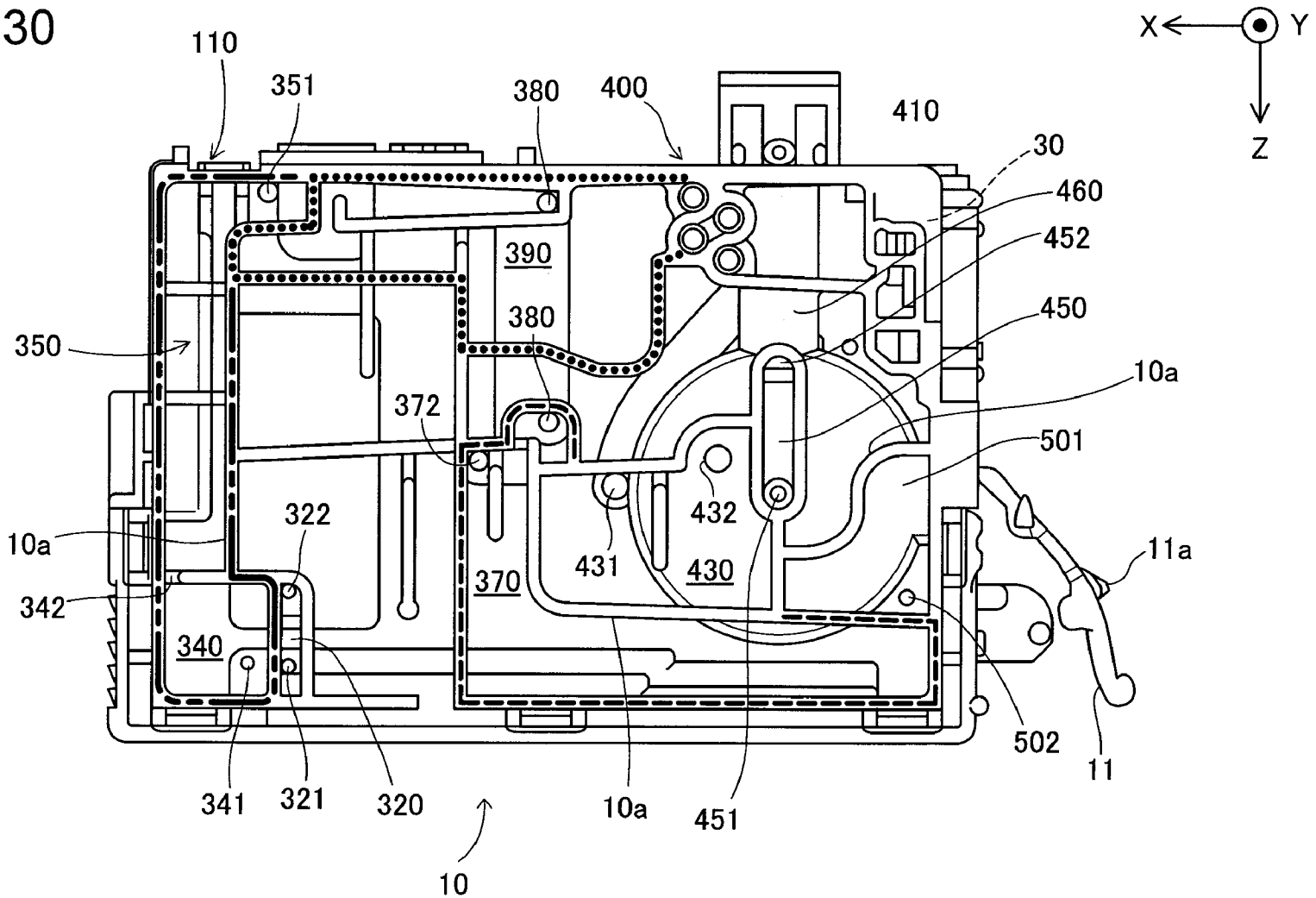
FIG. 30 is an explanatory view showing the internal structure of an ink cartridge in a third application of the modified example.
Figure 31:
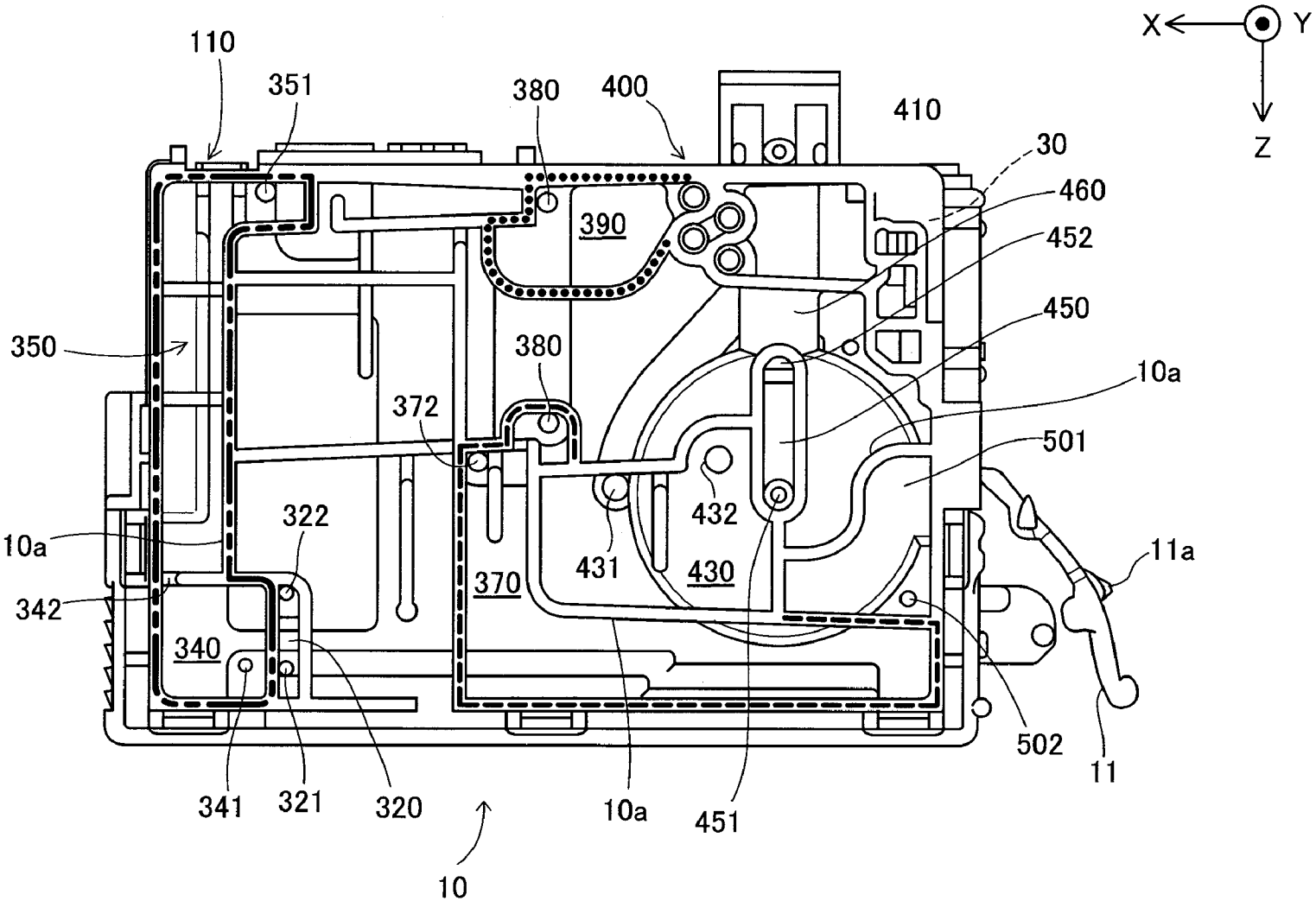
FIG. 31 is an explanatory view showing the internal structure of an ink cartridge in a fourth application of the modified example.

(2) The ink cartridge 1 of the embodiment has the tank chamber 370 and the end chamber 390 as the ink reservoirs in the ink reservoir assembly. The ink reservoir assembly may, however, only one ink reservoir. Such modification desirably reduces the total number of divisional walls to be provided inside the ink cartridge 1. For example, in the ink supply system by the third connection example, the tank chamber 370 and the end chamber 390 may be combined to form an integral ink reservoir. In this modified structure, the ink supply tube 910 is connected with this integral ink reservoir, and a communication hole (communicating path) open to an upstream air chamber, for example, the fifth air chamber 360, communicating with the integral ink reservoir is blocked. The tank chamber 370 and the end chamber 390 may have varying capacities as shown in FIGS. 28 through 31. FIG. 28 is an explanatory view showing the internal structure of an ink cartridge in a first application of this modified example. FIG. 29 is an explanatory view showing the internal structure of an ink cartridge in a second application of the modified example. FIG. 30 is an explanatory view showing the internal structure of an ink cartridge in a third application of the modified example. FIG. 31 is an explanatory view showing the internal structure of an ink cartridge in a fourth application of the modified example. In the first through the fourth applications of the modified example shown in FIGS. 28 through 31, an area defined by a two-dot chain line L1 represents the first through the fifth air chambers 320 through 360, an area defined by a dotted line L2 represents the tank chamber 370, and an area defined by a broken line L3 represents the end chamber 390.

In the first application of FIG. 28, the ink cartridge 1 has the tank chamber 370 of a largest capacity and the end chamber 390 of a largest capacity. In the second application of FIG. 29, the ink cartridge 1 has the tank chamber 370 of a smallest capacity and the end chamber 390 of a second largest capacity. In the third application of FIG. 30, the ink cartridge 1 has the tank chamber 370 of a smallest capacity and the end chamber 390 of a third largest capacity. In the fourth application of FIG. 31, the ink cartridge 1 has the tank chamber 370 of a smallest capacity and the end chamber 390 of a smallest capacity. Here the terminologies 'smallest' and 'largest' simply mean the maximum and the minimum in the structures of FIGS. 28 through 31 and do not exclude the possibilities of a further smaller capacity and a further greater capacity in other structures. In the structures of FIGS. 28 through 31, any divisional space other than the tank chamber 370 or the end chamber 390 may function as an air chamber.

(3) In the ink supply system of the embodiment, the ink supply tube 910 is connected with one of the vertical communicating path 400, the chamber-to-chamber communicating path 380, and the tank chamber 370. This structure is, however, neither essential nor restrictive. The ink supply tube 910 may otherwise be connected with one of the end chamber 390, the first through the fifth air chambers 320, 330, 340, 350, and 360, and the bubble separation chamber 410. The ink supply to the ink cartridge 1 at any position in the upstream of the sensor unit 30 ensures the same effects as those discussed above. For example, in the first through the fourth applications of the modified example (2) shown in FIGS. 28 through 31, the ink supply tube 910 may be connected at any positions elected among the first through the fifth air chambers 320 through 360 defined by the two-dot chain line L1, the tank chamber 370 defined by the dotted line L2, and the end chamber 390 defined by the broken line L3.

(4) In the ink supply system of the embodiment, the vertical communicating path 400 arranged in the vertical direction is used as the first communicating path of connecting the bubble separation chamber 410 with the end chamber 390. A horizontal communicating path arranged in a horizontal direction on the bottom face of the ink cartridge 1 may be used alternatively as the first communicating path.

(5) The above embodiment describes the ink-jet printer as a typical example of the liquid ejection apparatus. The liquid ejection apparatus is, however, not restricted to the ink-jet printer but may be designed to inject, eject, or spray a liquid other than ink (for example, a dispersion liquid containing particles of a functional material or a gelled liquid) or a fluid in a non-liquid state (for example, a fluid in a solid state). Some typical examples of such liquid ejection apparatus include a dispersion liquid ejection apparatus designed for injection of a dispersion liquid of an electrode material, a coloring material, or another relevant material to manufacture, for example, liquid crystal displays, EL displays, surface-emitting displays, and color filters, a liquid ejection apparatus designed for injection of a bioorganic material to manufacture biochips, and a liquid ejection apparatus designed as a precision pipette for injection of a sample liquid. Other examples of the liquid ejection apparatus include a liquid ejection apparatus designed for pinpoint ejection of lubricating oil to an object precision machine, such as a watch or a camera, a liquid ejection apparatus designed for ejection of a transparent resin solution of, for example, an ultraviolet curable resin, onto a substrate to manufacture a hemispherical microlens (optical lens) used for an optical communication element, a liquid ejection apparatus designed for ejection of an acid or alkali etching solution to etch a substrate, a fluid ejection apparatus designed for spray of a gelled liquid, and a powder-jet recording device designed to eject a fluid in a solid state, such as, toner.

The embodiment, its applications, and its modified examples discussed above are to be considered in all aspects as illustrative for the better understanding and not restrictive. The present invention may be embodied in other specific forms with some modifications, changes, and alterations without departing from the scope or spirit of the main characteristics of the present invention. The scope of the invention is, therefore, indicated by the appended claims rather than by the foregoing description. All changes that come within the meaning and range of equivalency of the claims are to be embraced within their scope.

The following Japanese patent application as the basis of the priority claim of this application is incorporated in the disclosure hereof by reference:

Japanese Patent Application No. 2008-138569 (filing date: May 27, 2008).

What is claimed is:

1. A liquid supply system configured to supply a liquid to a liquid ejection apparatus, the liquid supply system comprising:

a liquid container having a liquid reservoir assembly designed to store the liquid therein, an air communicating structure provided in the upstream of the liquid reservoir assembly to connect the liquid reservoir assembly with the outside air, a bubble separation structure provided in the downstream of the liquid reservoir assembly to separate bubbles included in the liquid, a first communicating path arranged to connect the bubble separation structure with the liquid reservoir assembly, a detector located in the downstream of the bubble separation structure to detect a liquid level in the liquid reservoir assembly, and a liquid supply structure provided in the downstream of the detector to supply the liquid to the liquid ejection apparatus;

a liquid supply line connected with the first communicating path at a location upstream of the detector;

an external liquid tank; and an external liquid supply apparatus connected with the liquid supply line and the external liquid tank to supply the liquid from the external liquid tank to the liquid container.

2. The liquid supply system in accordance with claim 1, wherein the liquid reservoir assembly has a first liquid reservoir, a second liquid reservoir provided in the downstream of the first liquid reservoir, and a second communicating path arranged to connect the first liquid reservoir with the second liquid reservoir, and the liquid supply line is connected with the second communicating path.

3. The liquid supply system in accordance with claim 1, wherein the liquid reservoir assembly has a first liquid reservoir, a second liquid reservoir provided in the downstream of the first liquid reservoir, and a second communicating path arranged to connect the first liquid reservoir with the second liquid reservoir, the liquid supply system further comprising:

a third communicating path arranged to connect the first liquid reservoir with the air communicating structure, wherein the liquid supply line is connected with the first liquid reservoir, and the third communicating path is blocked.

4. A manufacturing method of a liquid supply system configured to supply a liquid to a liquid ejection apparatus, the manufacturing method of the liquid supply system comprising:

providing a liquid container, which is attachable to the liquid ejection apparatus and has a liquid reservoir assembly designed to store the liquid therein, an air communicating structure provided to connect the liquid reservoir assembly with the outside air, a bubble separation structure provided in the downstream of the liquid reservoir assembly to separate bubbles included in the liquid, a first communicating path arranged to connect the bubble separation structure with the liquid reservoir assembly, a detector located in the downstream of the bubble separation structure to detect a liquid level in the liquid reservoir assembly, and a liquid supply structure provided in the downstream of the detector to supply the liquid to the liquid ejection apparatus;

connecting a liquid supply line with the liquid container in the upstream of the detector; and connecting the liquid supply line to an external liquid supply device constructed to supply the liquid to the liquid container.

5. The manufacturing method of the liquid supply system in accordance with claim 4, wherein the liquid supply line is connected with the liquid container by linking the liquid supply line to the first communicating path.

6. The manufacturing method of the liquid supply system in accordance with claim 5, wherein the connection of the liquid supply line with the liquid container includes:

piercing or cutting out an outer wall member of the liquid container, which is exposed on an attachment structure of the liquid ejection apparatus in attachment of the liquid container to the attachment structure, and at least one wall member provided in a pathway from the outer wall member to the first communicating path to form holes or cutouts;

laying out the liquid supply line to the first communicating path via the holes or cutouts formed in the outer wall member and the at least one wall member; and connecting and sealing one end of the liquid supply line with the first communicating path.

7. The manufacturing method of the liquid supply system in accordance with claim 4, wherein the liquid reservoir assembly has a first liquid reservoir, a second liquid reservoir provided in the downstream of the first liquid reservoir, and a second communicating path arranged to connect the first liquid reservoir with the second liquid reservoir, and the liquid supply line is connected with the liquid container by linking the liquid supply line to the second communicating path.

8. The manufacturing method of the liquid supply system in accordance with claim 7, wherein the connection of the liquid supply line with the liquid container includes:

piercing or cutting out an outer wall member of the liquid container, which is exposed on an attachment structure of the liquid ejection apparatus in attachment of the liquid container to the attachment structure, and at least one wall member provided in a pathway from the outer wall member to the second communicating path to form holes or cutouts;

laying out the liquid supply line to the second communicating path via the holes or cutouts formed in the outer wall member and the at least one wall member; and connecting and sealing one end of the liquid supply line with the second communicating path.

9. The manufacturing method of the liquid supply system in accordance with claim 4, wherein the liquid reservoir assembly has a first liquid reservoir, a second liquid reservoir provided in the downstream of the first liquid reservoir, and a second communicating path arranged to connect the first liquid reservoir with the second liquid reservoir, the manufacturing method of the liquid supply system further comprising:

connecting the first liquid reservoir with the air communicating structure via a third communicating path;

linking the liquid supply line to the first liquid reservoir to connect the liquid supply line with the liquid container; and blocking the third communicating path.

10. The manufacturing method of the liquid supply system in accordance with claim 9, wherein the connection of the liquid supply line with the liquid container includes:

piercing or cutting out an outer wall member of the liquid container, which is exposed on an attachment structure of the liquid ejection apparatus in attachment of the liquid container to the attachment structure, and at least one wall member provided in a pathway from the outer wall member to the first liquid reservoir to form holes or cutouts;

laying out the liquid supply line to the first liquid reservoir via the holes or cutouts formed in the outer wall member and the at least one wall member; and connecting and sealing one end of the liquid supply line with a hole or a cutout formed in a wall member of the first liquid reservoir.

11. A manufacturing method of a liquid container used for a liquid supply system configured to supply a liquid to a liquid ejection apparatus, the manufacturing method of the liquid container comprising:

providing the liquid container, which is attachable to the liquid ejection apparatus and has a liquid reservoir assembly designed to store the liquid therein, an air communicating structure provided to connect the liquid reservoir assembly with the outside air, a bubble separation structure provided in the downstream of the liquid reservoir assembly to separate bubbles included in the liquid, a first communicating path arranged to connect the bubble separation structure with the liquid reservoir assembly, a detector located in the downstream of the bubble separation structure to detect a liquid level in the liquid reservoir assembly, and a liquid supply structure provided in the downstream of the detector to supply the liquid to the liquid ejection apparatus; and connecting a liquid supply line to the liquid container in the upstream of the detector.

12. The manufacturing method of the liquid container in accordance with claim 11, wherein the connection of the liquid supply line with the liquid container includes:

piercing or cutting out an outer wall member of the liquid container, which is exposed on an attachment structure of the liquid ejection apparatus in attachment of the liquid container to the attachment structure, and at least one wall member provided in a pathway from the outer wall member to the first communicating path to form holes or cutouts;

laying out the liquid supply line to the first communicating path via the holes or cutouts formed in the outer wall member and the at least one wall member; and connecting and sealing one end of the liquid supply line with the first communicating path.

* * * * *